US012144407B2

(12) United States Patent
Lv

(10) Patent No.: US 12,144,407 B2
(45) Date of Patent: Nov. 19, 2024

(54) UMBRELLA POLE DEVICE, ELECTRIC UMBRELLA AND TELESCOPIC DEVICE

(71) Applicant: Sunbao Lv, Quanzhou (CN)

(72) Inventor: Sunbao Lv, Quanzhou (CN)

( * ) Notice: Subject to any disclaimer, the term of this patent is extended or adjusted under 35 U.S.C. 154(b) by 115 days.

(21) Appl. No.: 18/151,605

(22) Filed: Jan. 9, 2023

(65) Prior Publication Data

US 2023/0157426 A1 May 25, 2023

Related U.S. Application Data

(63) Continuation of application No. PCT/CN2021/075860, filed on Feb. 7, 2021.

(30) Foreign Application Priority Data

Jul. 10, 2020 (CN) ..... 202010666410.5

(51) Int. Cl.
*A45B 19/04* (2006.01)
*A45B 19/08* (2006.01)
(Continued)

(52) U.S. Cl.
CPC ..... *A45B 19/04* (2013.01); *A45B 19/08* (2013.01); *A45B 25/02* (2013.01); *A45B 25/14* (2013.01); *A45B 25/143* (2013.01)

(58) Field of Classification Search
CPC ..... A45B 19/04; A45B 19/08; A45B 25/14; A45B 25/143; A45B 25/165; A45B 25/16;
(Continued)

(56) References Cited

U.S. PATENT DOCUMENTS 295,351 A * 3/1884 Charageat ..... A45B 25/143 135/22
6,070,602 A * 6/2000 Ling Kuo ..... A45B 25/16 135/25.4
(Continued)

FOREIGN PATENT DOCUMENTS

CN 105795635 A 7/2016
CN 206462545 U 9/2017
(Continued)

OTHER PUBLICATIONS

International Search Report and Written Opinion issued in corresponding PCT Application No. PCT/CN2021/075860, dated May 12, 2021.
(Continued)

*Primary Examiner* — Robert Canfield
(74) *Attorney, Agent, or Firm* — Westbridge IP LLC

(57) ABSTRACT

Disclosed are an umbrella pole device, an electric umbrella and a telescopic device. The umbrella pole device includes an umbrella head, a middle rod, and an umbrella pole transmission assembly. The middle rod includes a plurality of casings, the casing in an innermost part of the middle rod is an inner casing, the casing in an outermost part of the middle rod is an outer casing, and one end of the inner casing is connected to the umbrella head. The umbrella pole transmission assembly is arranged in the inner casing, including a first transmission tube and a second transmission tube. The first transmission tube is telescopically sleeved with the second transmission tube. One end of the transmission tube is rotatably connected to the umbrella head, and one of the first transmission tube and the second transmission tube is a rectangular spring.

13 Claims, 18 Drawing Sheets

(51) Int. Cl.
*A45B 25/02* (2006.01)
*A45B 25/14* (2006.01)

(58) Field of Classification Search
CPC ... A45B 2009/007; A45B 19/00; A45B 25/02; A45B 2200/1009; A45B 25/00; A45B 11/00; A45B 2025/003; A45B 3/00; A45B 9/02; A45B 2200/1081; F41B 15/022; F41B 15/2077; A63C 11/221
USPC ..... 135/25.1–25.41, 75
See application file for complete search history.

(56) References Cited

U.S. PATENT DOCUMENTS 6,257,257 B1* 7/2001 Shih ..... A45B 25/143 135/25.4
6,338,353 B1* 1/2002 Chen ..... A45B 25/143 135/25.1
6,360,759 B1* 3/2002 Lin ..... A45B 25/143 135/25.1
6,782,903 B1* 8/2004 Jarman ..... F16B 7/105 135/65
8,899,250 B1 12/2014 Tung
2006/0060234 A1* 3/2006 Liu ..... A45B 25/06 135/25.1
2010/0170545 A1 7/2010 Yang et al.
2014/0182641 A1* 7/2014 Chen ..... A45B 19/10 135/24
2015/0040954 A1* 2/2015 Ni ..... A45B 25/16 135/24
2015/0068568 A1* 3/2015 Wu ..... F16F 3/04 135/22
2018/0184769 A1* 7/2018 Jung ..... A45B 9/04
2019/0059534 A1* 2/2019 Lv ..... A45B 25/143

FOREIGN PATENT DOCUMENTS

CN 109998241 A 7/2019
CN 110074528 A 8/2019
CN 111772307 A 10/2020
JP S6431019 U 2/1989
JP H08200466 A 8/1996
JP 2015073905 A 4/2015
JP 2015217307 A 12/2015
KR 20010084676 A 9/2001
KR 20070116782 A 12/2007
KR 20180133398 A 12/2018
KR 102012244 B1 10/2019
WO 2020140439 A1 7/2020

OTHER PUBLICATIONS

Notice of Final Rejection issued in counterpart Korean Patent Application No. KR 10-2023-7004676, dated May 3, 2024.
Notice of Reasons for Refusal issued in counterpart Japanese Patent Application No. JP 2023-501340, dated Apr. 23, 2024.
Request for the Submission of an Opinion issued in counterpart Korean Patent Application No. KR 10-2023-7004676, dated Feb. 29, 2024.

* cited by examiner

UMBRELLA POLE DEVICE, ELECTRIC UMBRELLA AND TELESCOPIC DEVICE

CROSS-REFERENCE TO RELATED APPLICATIONS

This application is a continuation application of International Application No. PCT/CN2021/075860, filed on Feb. 7, 2021, which claims priority to Chinese Patent Application No. 202010666410.5, filed on Jul. 10, 2020. The disclosures of the above-mentioned applications are incorporated herein by reference in their entireties.

TECHNICAL FIELD

The present disclosure relates to the technical field of electric umbrellas, and in particular to an umbrella pole device, an electric umbrella and a telescopic device.

BACKGROUND

After being folded, the umbrella is of a small length, and is very convenient to carry or store, thus it is deeply loved by the majority of users. However, traditional folding umbrella usually requires both hands of the user to open or fold. When the user holds some stuff in one hand and the umbrella in another, it is not convenient to open or fold the umbrella quickly. In order to open or fold the umbrella more conveniently and quickly, electric umbrellas are invented. The electric umbrella usually includes an umbrella pole device and an umbrella rib device arranged on the umbrella pole device. When the electric umbrella is opened, the umbrella pole device needs to be extended and the umbrella rib device needs to be stretched. When the electric umbrella is folded, the umbrella pole device needs to be shortened and the umbrella rib device needs to be retracted.

As for the traditional electric umbrella, when the electric umbrella is in a folded state, the spring is in a compressed state. When the electric umbrella needs to be opened, the compressed spring is driven to be released by the motor, so that the spring is stretched, and the electric umbrella is opened. When the electric umbrella needs to be folded, the spring is driven to be compressed again by the motor. Although compressing and releasing the spring can realize the opening and folding of the electric umbrella, it requires a relatively high torque of the motor, thus the motor with the high torque is needed.

SUMMARY

The main objective of the present disclosure is to provide an umbrella pole device, aiming to decrease the torque requirement for the motor.

In order to realize the above objective, the present disclosure provides an umbrella pole device, including: an umbrella head, a middle rod, and an umbrella pole transmission assembly.

In an embodiment, the middle rod includes a plurality of casings, the plurality of the casings are pulled apart to form an end-to-end long rod, the casing in an innermost part of the middle rod is an inner casing, the casing in an outermost part of the middle rod is an outer casing, one end of the inner casing is connected to the umbrella head.

In an embodiment, the umbrella pole transmission assembly is arranged in the inner casing, the umbrella pole transmission assembly includes a first transmission tube and a second transmission tube, the first transmission tube is telescopically sleeved with the second transmission tube, one end of the first transmission tube is rotatably connected to the umbrella head, and one of the first transmission tube and the second transmission tube is a rectangular spring.

When the first transmission tube rotates in a first direction, the second transmission tube moves toward a direction away from the umbrella head to exert a force on the outer casing, and the plurality of casings of the middle rod are pulled apart to form the end-to-end long rod.

When the first transmission tube rotates in a second direction, the second transmission tube moves towards a direction close to the umbrella head to cancel the force applied on the outer casing, and the second direction is opposite to the first direction.

In an embodiment, the second transmission tube is a rectangular spring, and the rectangular spring is sleeved outside the first transmission tube;

the umbrella pole transmission assembly further includes a guiding spring portion and a first slider, the guiding spring portion is arranged at an end of the first transmission tube away from the umbrella head, the guiding spring portion is provided with a first guiding spring passage, at least part of coils of the rectangular spring are arranged in the first guiding spring passage, the first slider is slidably sleeved outside the first transmission tube, the first slider is arranged between the umbrella head and the rectangular spring, the first slider is connected to one end of the rectangular spring close to the umbrella head, and an outer wall of the first slider is cooperated with an inner wall of the inner casing to confine a rotation of the first slider.

In an embodiment, the umbrella pole transmission assembly further includes a threaded tube, an external transmission tube and a nut;

one end of the threaded tube is rotatably connected to the umbrella head;

the first transmission tube is slidably inserted into an end of the threaded tube away from the umbrella head, and an outer wall of the first transmission tube is cooperated with an inner wall of the threaded tube to confine a relative rotation between the first transmission tube and the threaded tube;

the external transmission tube is slidably sleeved outside the threaded tube, and when sliding on the threaded tube, the external transmission tube is configured to drive the first transmission tube and the guiding spring portion to slide;

the nut is sleeved outside the threaded tube and is screwed with the threaded tube, an outer wall of the nut is cooperated with the inner wall of the inner casing so that the nut is configured to move on the threaded tube, the nut is arranged between the umbrella head and the external transmission tube, and the nut is fixedly connected to an end of the external transmission tube close to the umbrella head; and the rectangular spring and the first slider are slidably sleeved outside the external transmission tube, and the inner wall of the first slider is cooperated with the outer wall of the external transmission tube to confine the rotation of the first slider.

In an embodiment, the umbrella pole transmission assembly further includes a T-shaped cylindrical pin and a bushing, the T-shaped cylindrical pin is sleeved outside the first transmission tube, and an inner wall of the T-shaped cylindrical pin is cooperated with the outer wall of the first transmission tube to limit a rotation of the T-shaped cylindrical pin;

the guiding spring portion is sleeved outside the T-shaped cylindrical pin, and a head end of the T-shaped cylindrical pin is arranged between the guiding spring portion and the umbrella head;

the bushing is sleeved outside the first transmission tube, and an end of the bushing away from the umbrella head is rotatably connected to the head end of the T-shaped cylindrical pin; and an end of the external transmission tube away from the umbrella head is sleeved outside the bushing.

In an embodiment, the umbrella pole transmission assembly further includes a first reinforcing tube, the first reinforcing tube is sleeved outside the rectangular spring, and is relatively fixed to the rectangular spring, and one end of the first reinforcing tube close to the umbrella head is connected to the first slider.

In an embodiment, the first transmission tube is a rectangular spring, and the second transmission tube is sleeved outside the rectangular spring;

the umbrella pole transmission assembly further includes a second slider, the second slider is sleeved outside the rectangular spring, the second slider is arranged between the umbrella head and the second transmission tube, and is fixedly connected to an end of the second transmission tube close to the umbrella head;

an inner wall of the second slider is provided with a second guiding spring passage, at least part of the coils of the rectangular spring are arranged in the second guiding spring passage, and an outer wall of the second slider is cooperated with the inner wall of the inner casing so that the second slider is configured to move on the rectangular spring.

In an embodiment, the umbrella pole transmission assembly further includes a second reinforcement tube, the rectangular spring is sleeved outside the second reinforcement tube and is relatively fixed to the second reinforcement tube, and an end of the second reinforcing tube close to the umbrella head is rotatably connected to the umbrella head.

In an embodiment, the first transmission tube is a rectangular spring, and the rectangular spring is sleeved outside the second transmission tube;

the umbrella pole transmission assembly further includes a third slider and an anti-rotation block;

the rectangular spring is sleeved outside the third slider, the third slider is fixedly connected to the end of the second transmission tube close to the umbrella head, an outer wall of the third slider is provided with a third guiding spring passage, at least part of the coils of the rectangular spring are arranged in the third guiding spring passage;

the anti-rotation block is arranged on an end of the inner casing away from the umbrella head, the second transmission tube is slidably inserted on the anti-rotation block, and an inner wall of the anti-rotation block is cooperated with the outer wall of the second transmission tube so that the third slider is configured to move on the rectangular spring.

In an embodiment, the umbrella pole transmission assembly further includes a third reinforcing tube, and the third reinforcing tube is sleeved outside the rectangular spring and is relatively fixed to the rectangular spring.

In an embodiment, the umbrella pole device further includes a driving assembly arranged in the umbrella head, the driving assembly includes a motor, a main gear, a slave gear and a gearbox, the main gear is arranged on an output shaft of the motor, the slave gear is arranged at one end of the first transmission tube close to the umbrella head, and a speed change gear of the gearbox is respectively engaged with the main gear and the slave gear.

In an embodiment, the umbrella pole device further includes an upper nest, a lower nest and an umbrella rib transmission assembly;

the upper nest is arranged at the end of the outer casing away from the umbrella head and is configured to be pushed by the second transmission tube;

the lower nest is slidably arranged on the outer casing, and the lower nest is arranged between the umbrella head and the upper nest;

the umbrella rib transmission assembly includes at least one upper pulley, at least one lower pulley, and a stay rope, the upper pulley is arranged on the upper nest, the lower pulley is arranged on the lower nest, one end of the stay rope is fixed to the umbrella head, another end passes through an innermost tube of the umbrella pole transmission assembly to alternately bypasses the upper pulley and the lower pulley, and is fixed on the upper nest or the lower nest.

The present disclosure also provides an electric umbrella, including:

the umbrella pole device; and an umbrella rib device including an umbrella rib and an umbrella cloth arranged on the umbrella rib;

the umbrella rib includes a first rib, a second rib, a tension spring and a third rib, one end of the first rib is connected to the upper nest, one end of the second rib is connected to the lower nest, another end of the second rib is slidably connected to the first rib, two ends of the tension spring are respectively connected to the first rib and the second rib, and the third rib is connected to another end of the first rib.

The present disclosure also provides a telescopic device, including:

a mounting seat, the mounting seat is the umbrella head;

a casing assembly, the casing assembly is the middle rod; and an inner transmission assembly, the inner transmission assembly is the umbrella pole transmission assembly.

In an embodiment, the telescopic device is applied to a selfie stick, a clothes rail or a robot, and an end of the outer casing away from the mounting seat is provided with a clamp positioning member;

when the telescopic device is applied to the selfie stick, the clamp positioning member is configured to fix a mobile phone or a camera;

when the telescopic device is applied to the clothes rail, the clamp positioning member is a fork; and when the telescopic device is applied to the robot, the clamp positioning member is a manipulator.

In the umbrella pole transmission assembly and the telescopic device, one end of the first transmission tube is rotatably connected to the umbrella head (mounting seat), the first transmission tube is telescopically sleeved with the second transmission tube. When the first transmission tube rotates, the second transmission tube can move towards the end away from the umbrella head (mounting seat), and can apply a force to the outer casing, so that multiple casings of the middle rod (casing assembly) are pulled apart to form an end-to-end long rod. In this way, the compression of the first transmission tube and the second transmission tube can be avoided, that is, the compression of the rectangular spring can be avoided. Therefore, when the first transmission tube is connected to the driving assembly, and the first transmission tube is driven to rotate by the driving assembly, the torque requirement for the driving assembly is relatively low. A driving assembly with a small torque can be used to drive the first transmission tube to rotate, and the driving assembly with a small torque is usually smaller in size, which can reduce the size of the umbrella head (mounting seat), and miniaturize the electric umbrella (telescopic device). In the actual manufacturing, under a premise of achieving the same effect, the price of the rectangular spring is far lower than that of the threaded rod. Using the rectangular spring as the transmission tube can reduce the production cost of the electric umbrella (telescopic device).

BRIEF DESCRIPTION OF THE DRAWINGS

In order to illustrate the technical solutions in the embodiments of the present disclosure or in the related art more clearly, the following briefly introduces the accompanying drawings required for the description of the embodiments or the prior art. Obviously, the drawings in the following description are only part of embodiments of the present disclosure. For those of ordinary skill in the art, other drawings can also be obtained according to the structures shown in these drawings without any creative effort.

The achievement of the purpose of the present disclosure, functional characteristics and advantages will be further described with reference to the accompanying drawings in conjunction with embodiments.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there are directional indications, such as up, down, left, right, front, rear, etc., involved in the embodiments of the present disclosure, the directional indications are only used to explain a certain posture as shown in the accompanying drawings. If the specific posture changes, the directional indication also changes accordingly.

In addition, if there are descriptions related to "first", "second", etc. in the embodiments of the present disclosure, the descriptions of "first", "second", etc. are only for the purpose of description, and should not be construed as indicating or implying relative importance or implicitly indicates the number of technical features indicated. Thus, a feature delimited with "first", "second" may expressly or implicitly include at least one of that feature. Besides, the meaning of "and/or" appearing in the disclosure includes three parallel scenarios. For example, "A and/or B" includes only A, or only B, or both A and B. In addition, the technical solutions between the various embodiments can be combined with each other, but must be based on the realization by those of ordinary skill in the art. When the combination of technical solutions is contradictory or cannot be realized, it should be considered that the combination of such technical solutions does not exist or fall within the scope of protection claimed in this disclosure.

The present disclosure provides an electric umbrella.

Figure 1:
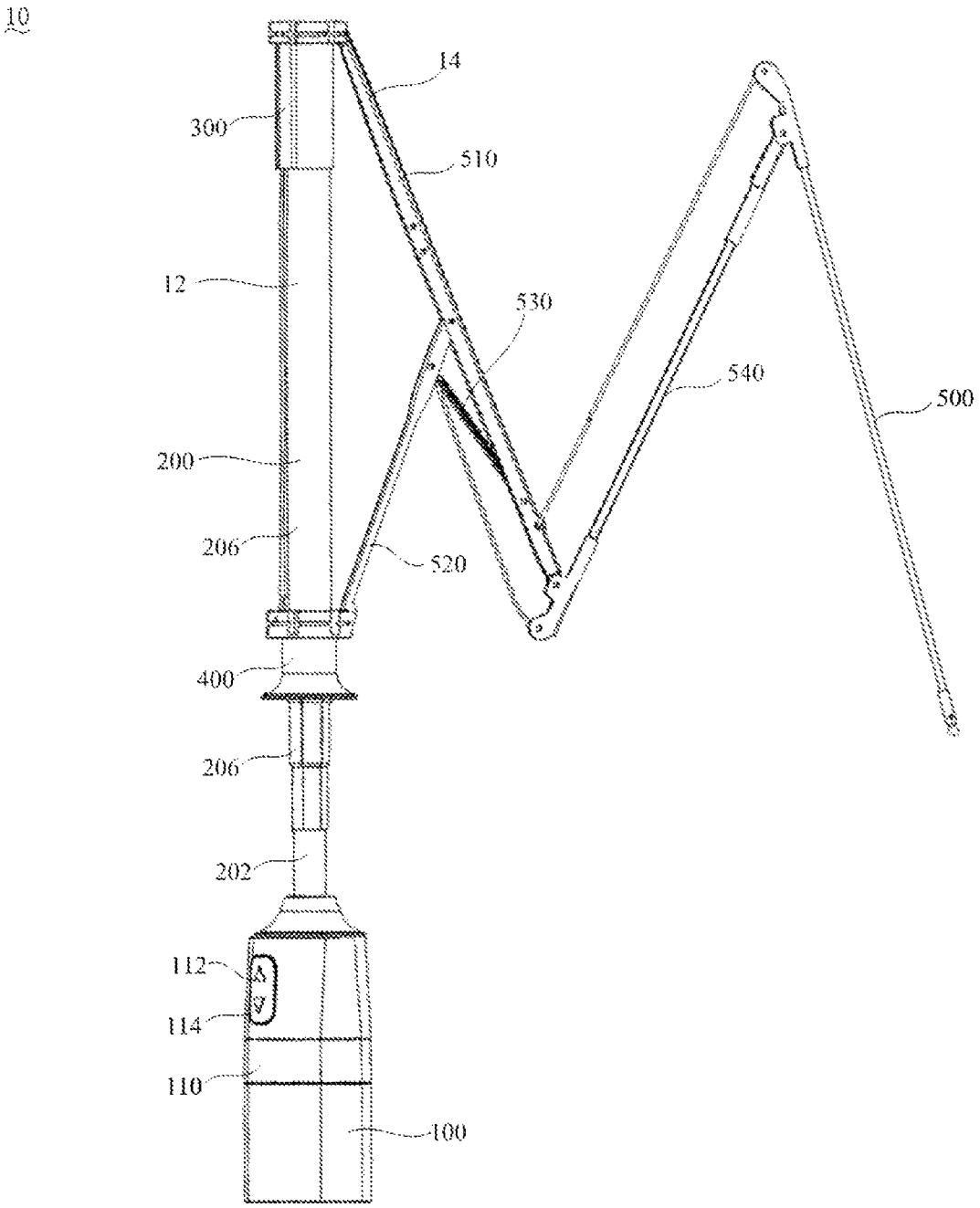
FIG. 1 is a schematic structural view of an electric umbrella according to an embodiment of the present disclosure.

In an embodiment of the present disclosure, as shown in FIG. 1, the electric umbrella 10 includes an umbrella pole device 12 and an umbrella rib device 14 arranged on the umbrella pole device 12. When the electric umbrella 10 is opened, the umbrella pole device 12 needs to be extended, and the umbrella rib device 14 needs to be stretched. When the electric umbrella 10 is folded, the umbrella pole device 12 needs to be shortened and the umbrella rib device 14 needs to be retracted.

In an embodiment, the umbrella pole device 12 includes an umbrella head 100, a middle rod 200, an upper nest 300 and a lower nest 400. The umbrella rib device 14 includes an umbrella rib 500 and an umbrella cloth.

Figure 2:
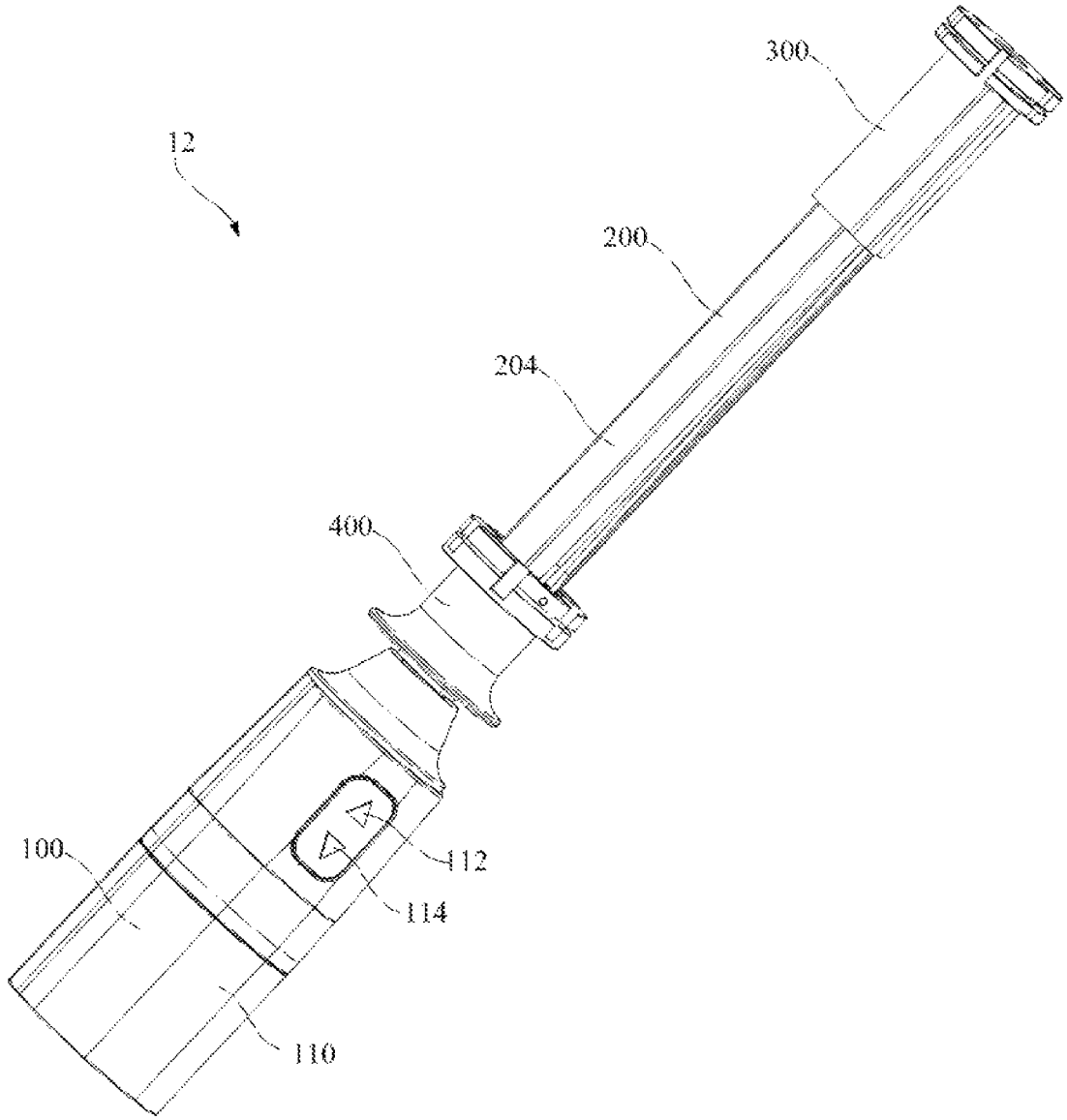
FIG. 2 is a schematic structural view of an umbrella pole device of the electric umbrella in FIG. 1.
Figure 3:
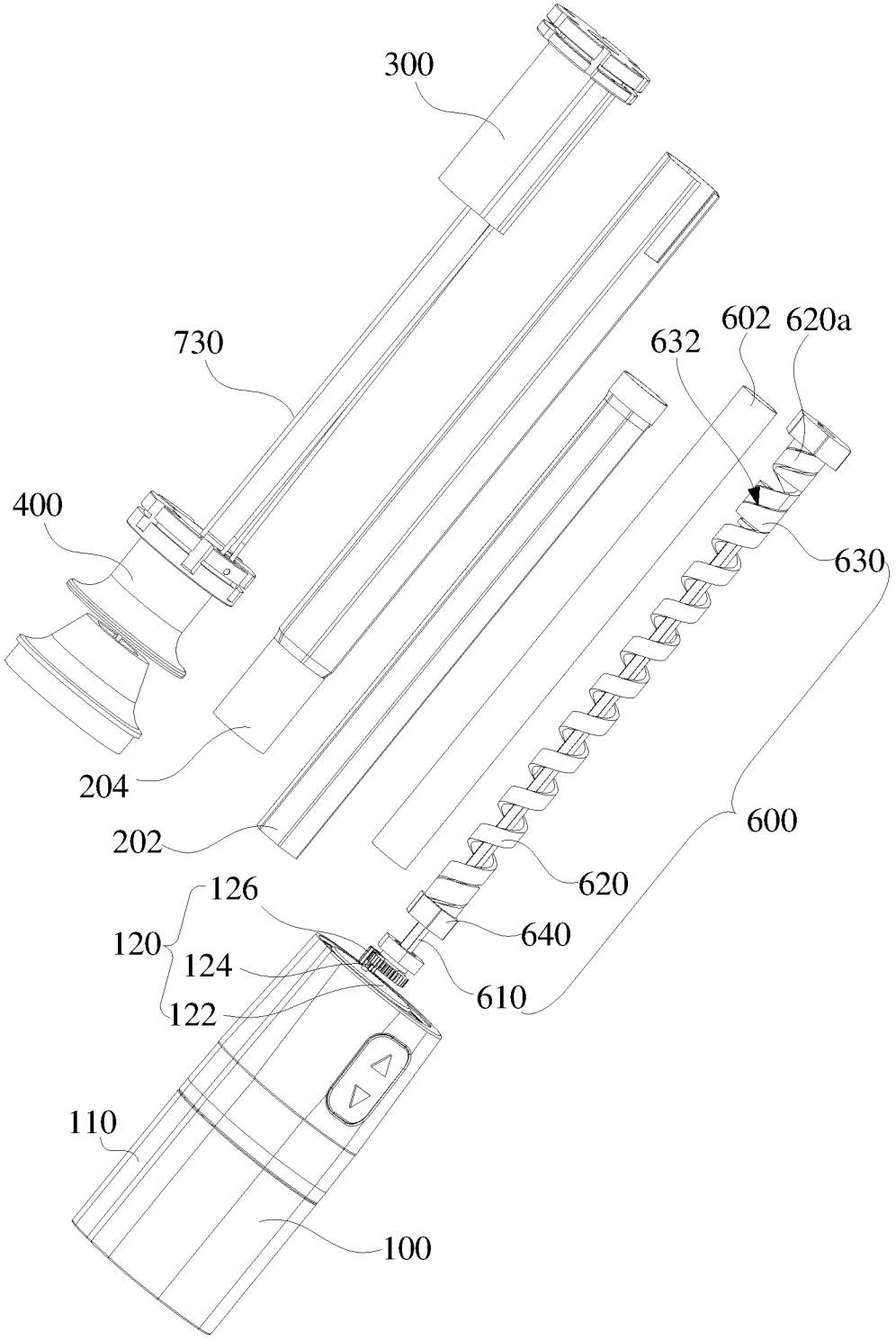
FIG. 3 is a three-dimensional exploded view of an umbrella pole device of an electric umbrella according to an embodiment of the present disclosure.
Figure 4:
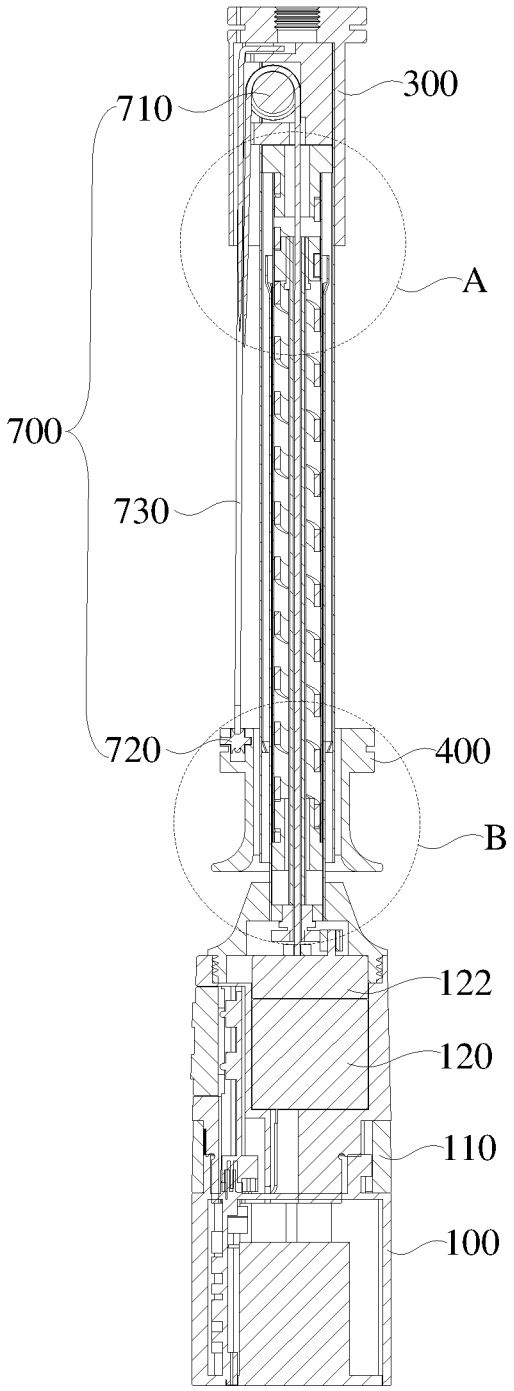
FIG. 4 is a sectional view of an umbrella pole device of the electric umbrella in FIG. 3.
Figure 5:
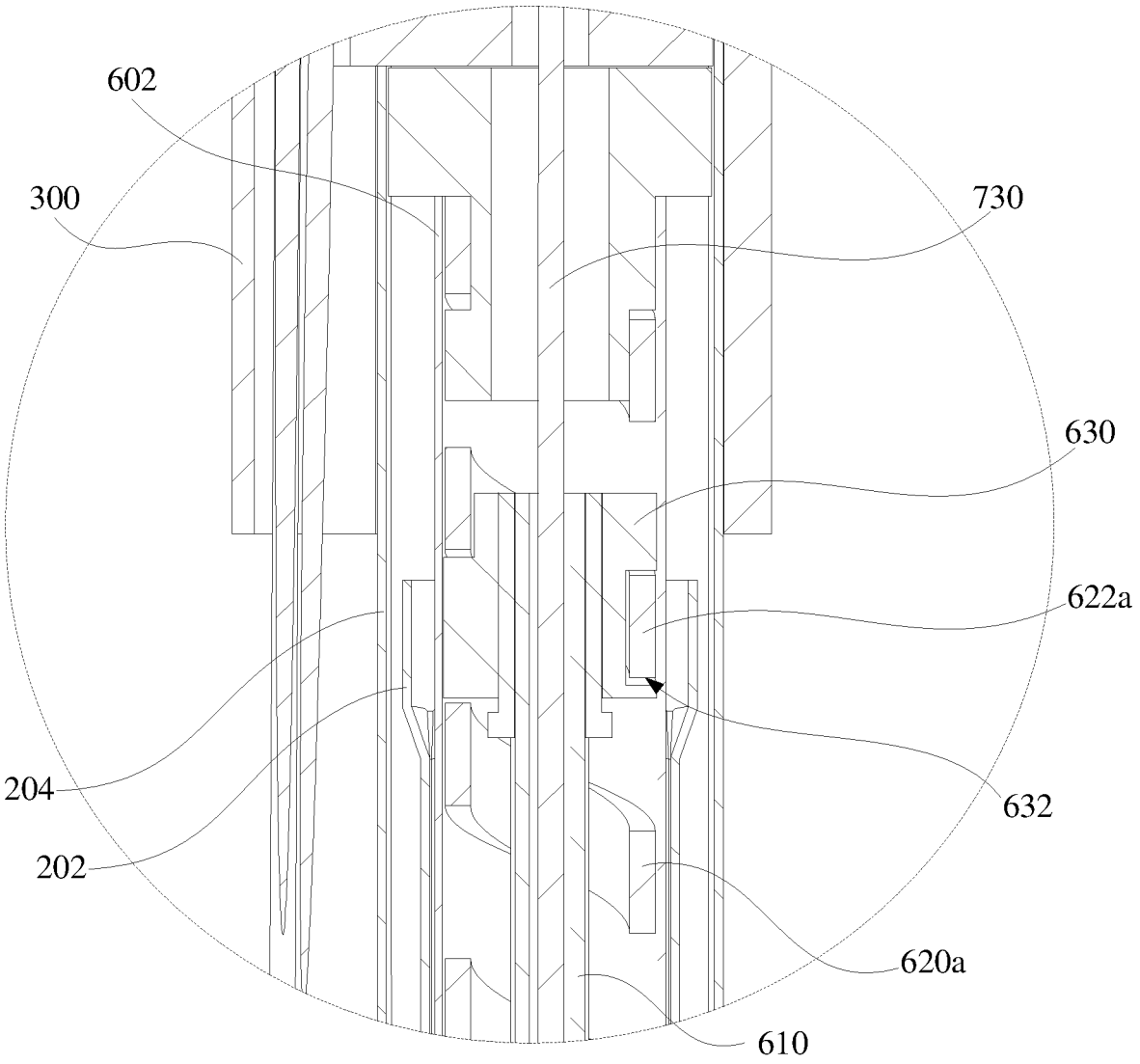
FIG. 5 is a partial enlarged view at A in FIG. 4.
Figure 6:
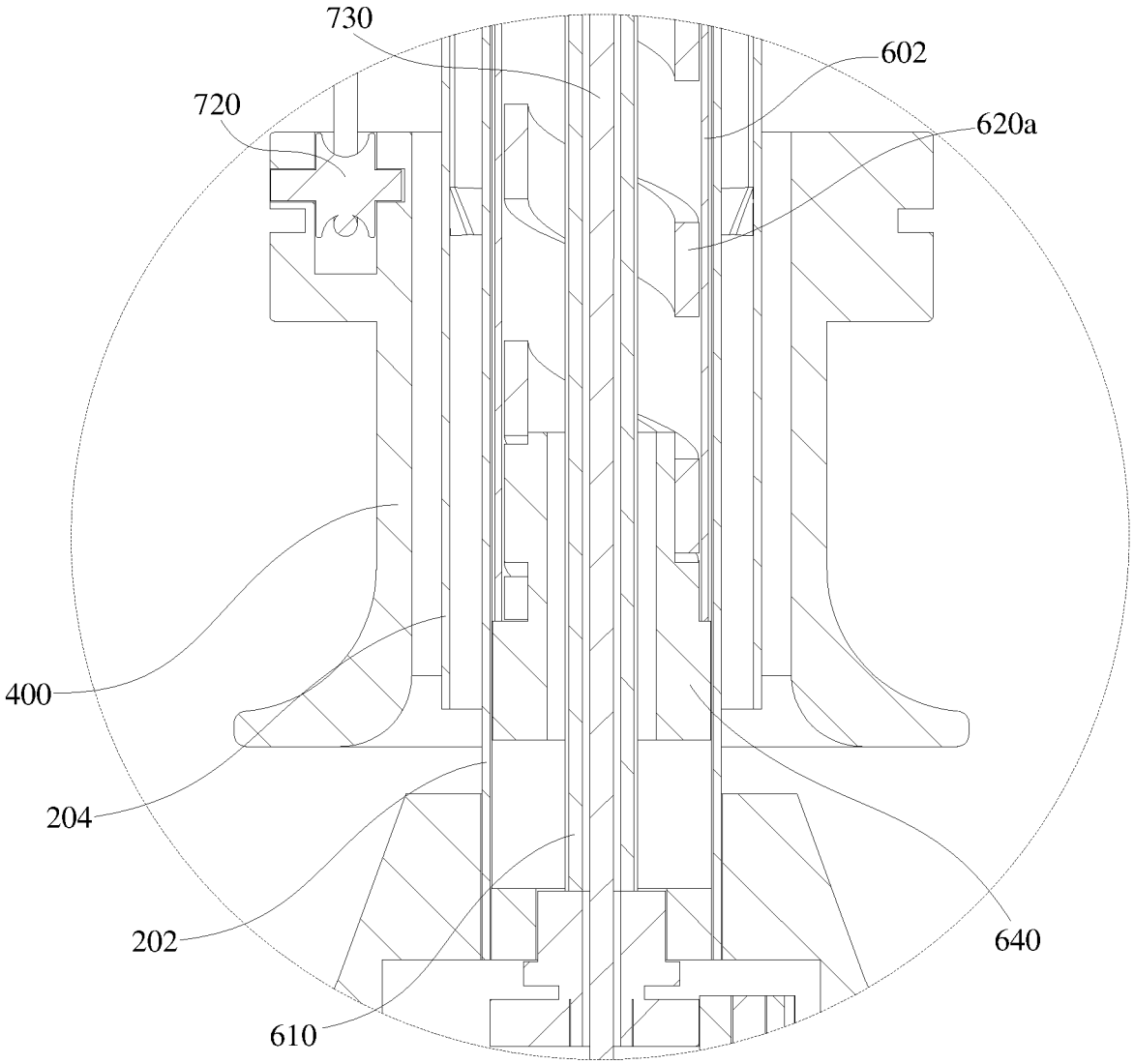
FIG. 6 is a partial enlarged view at B in FIG. 4.
Figure 7:
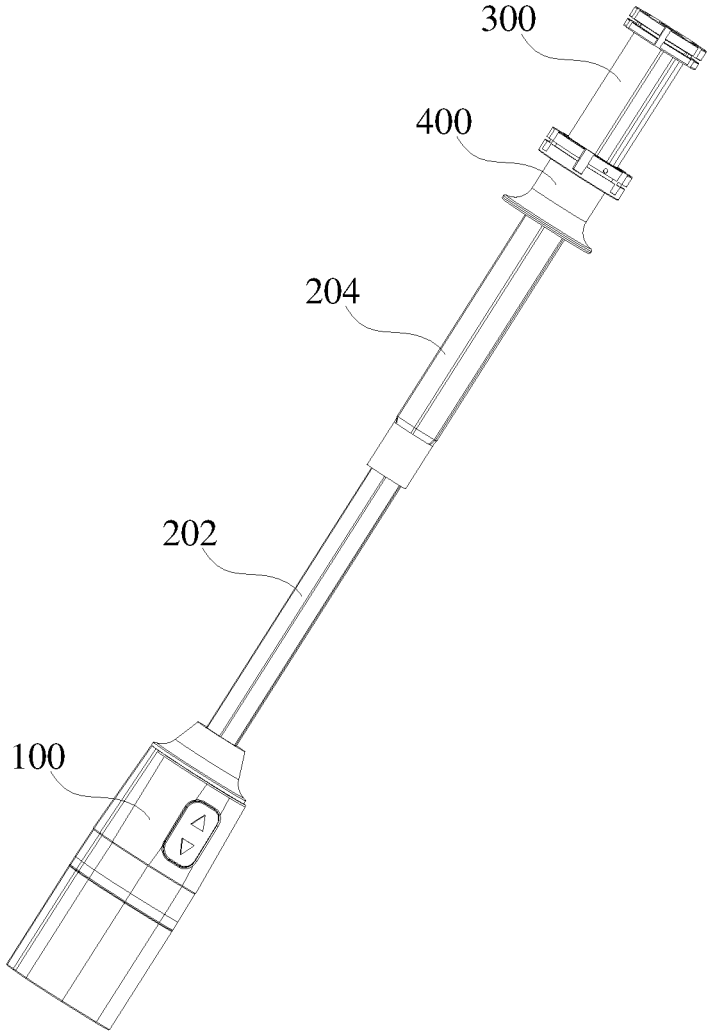
FIG. 7 is a three-dimensional structural schematic view of the umbrella pole device of the electric umbrella in FIG. 3 in a pulled state.
Figure 8:
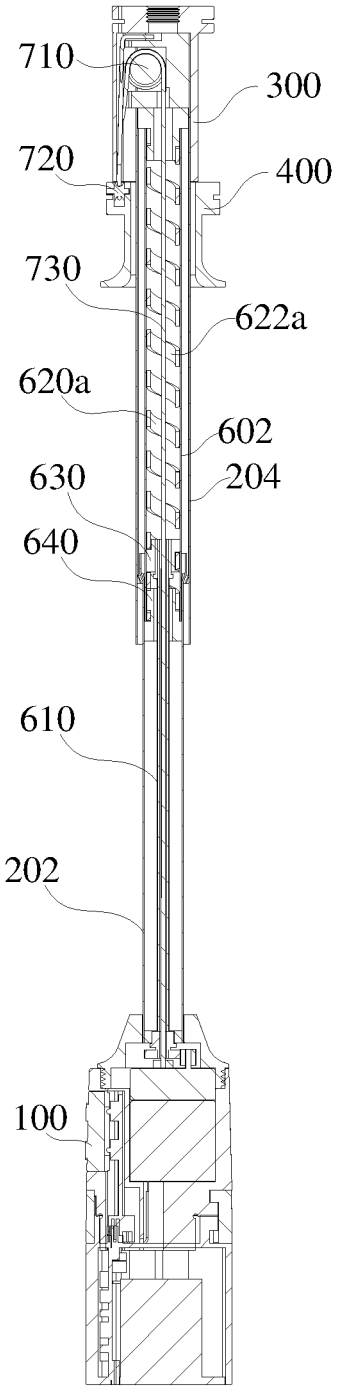
FIG. 8 is a sectional view of FIG. 7.
Figure 9:
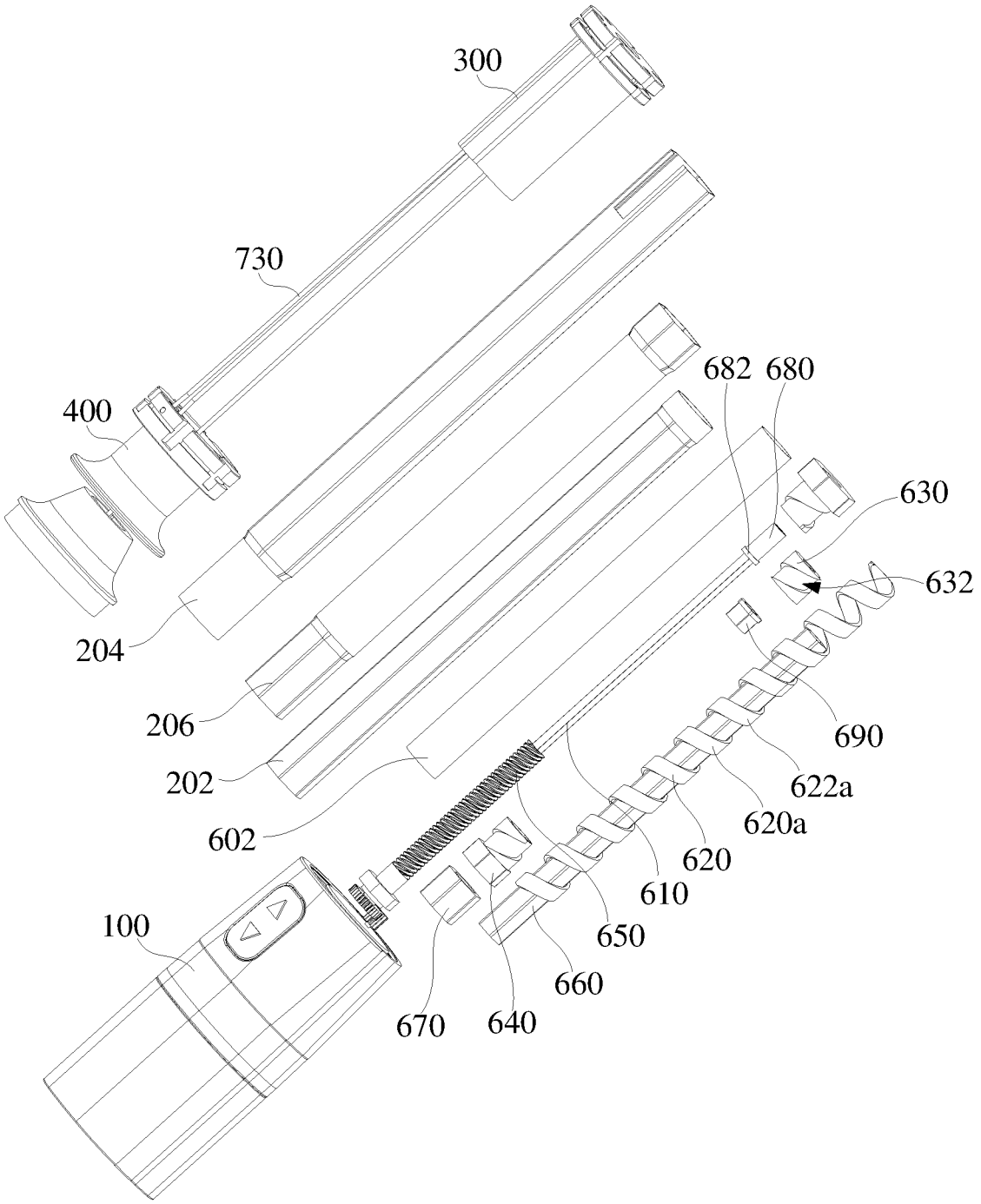
FIG. 9 is a three-dimensional exploded view of an umbrella pole device of an electric umbrella according to an embodiment of the present disclosure.
Figure 10:
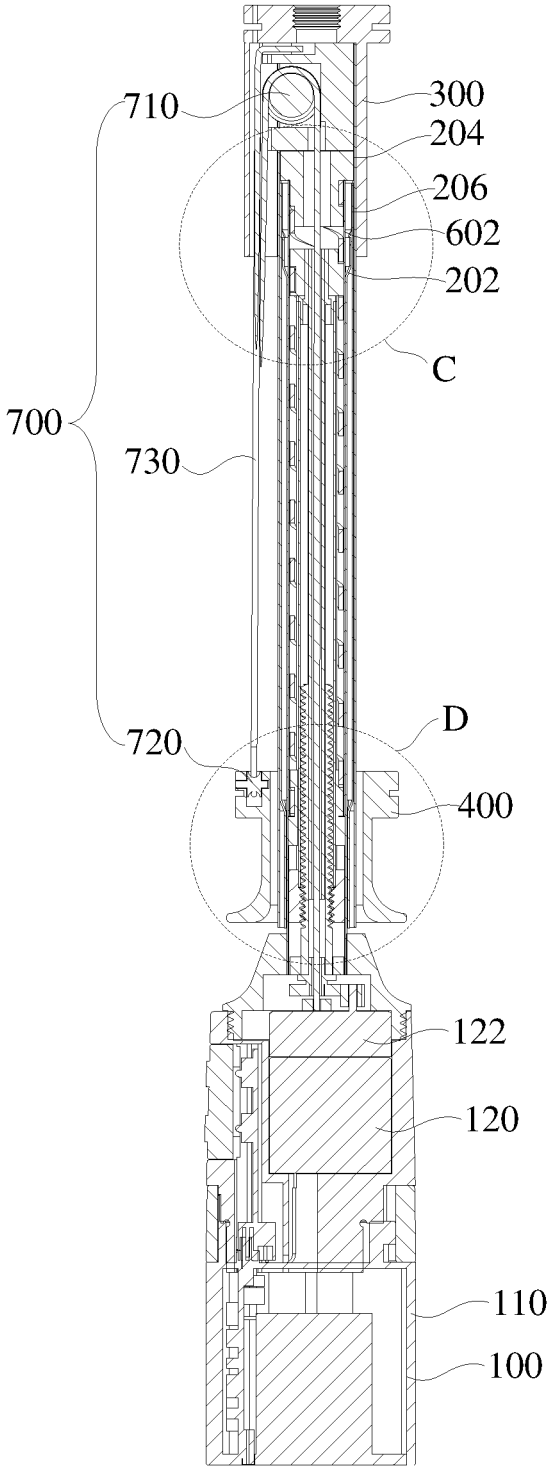
FIG. 10 is a sectional view of the umbrella pole device of the electric umbrella in FIG. 9.
Figure 11:
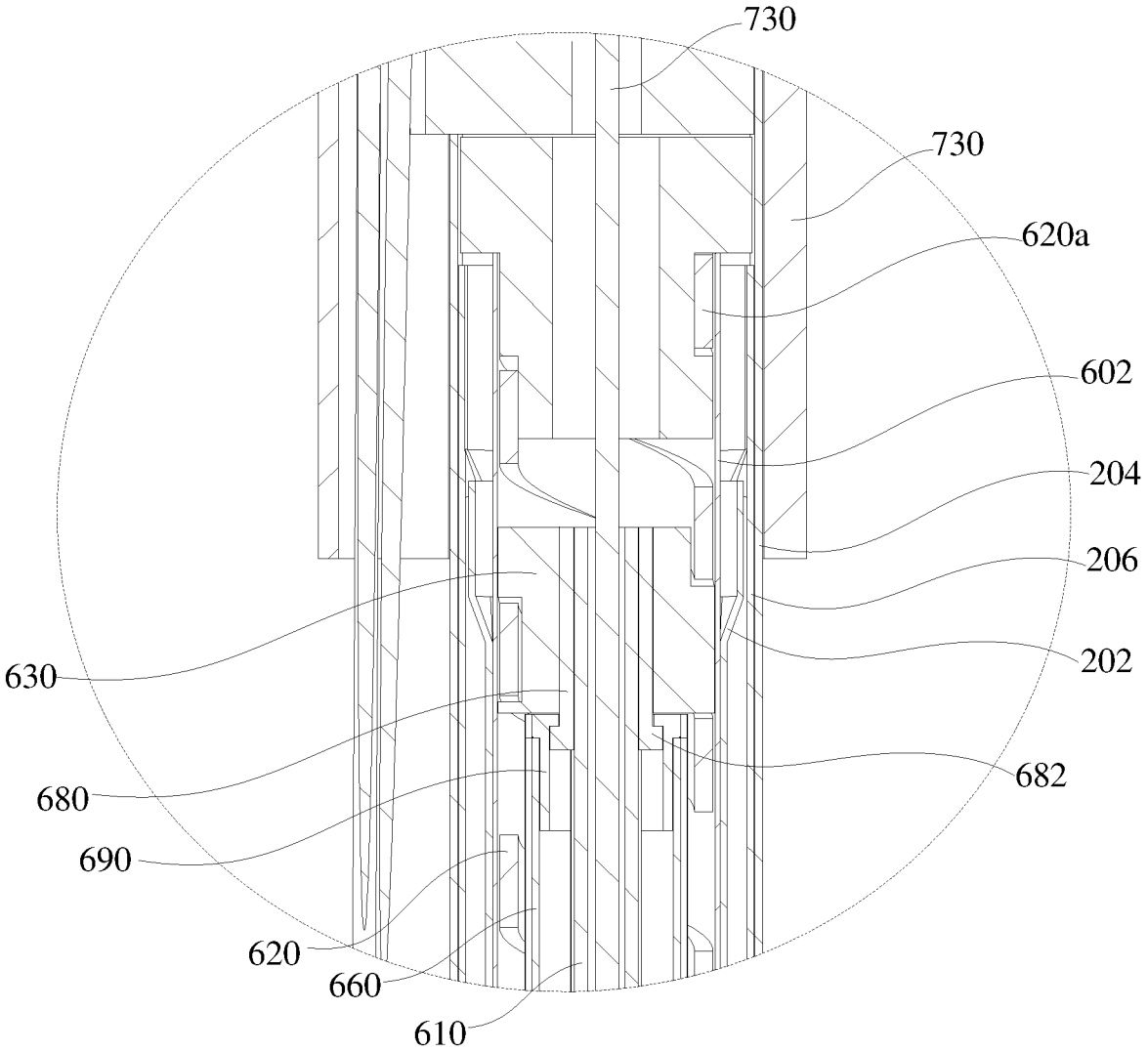
FIG. 11 is a partial enlarged view at C in FIG. 10.
Figure 12:
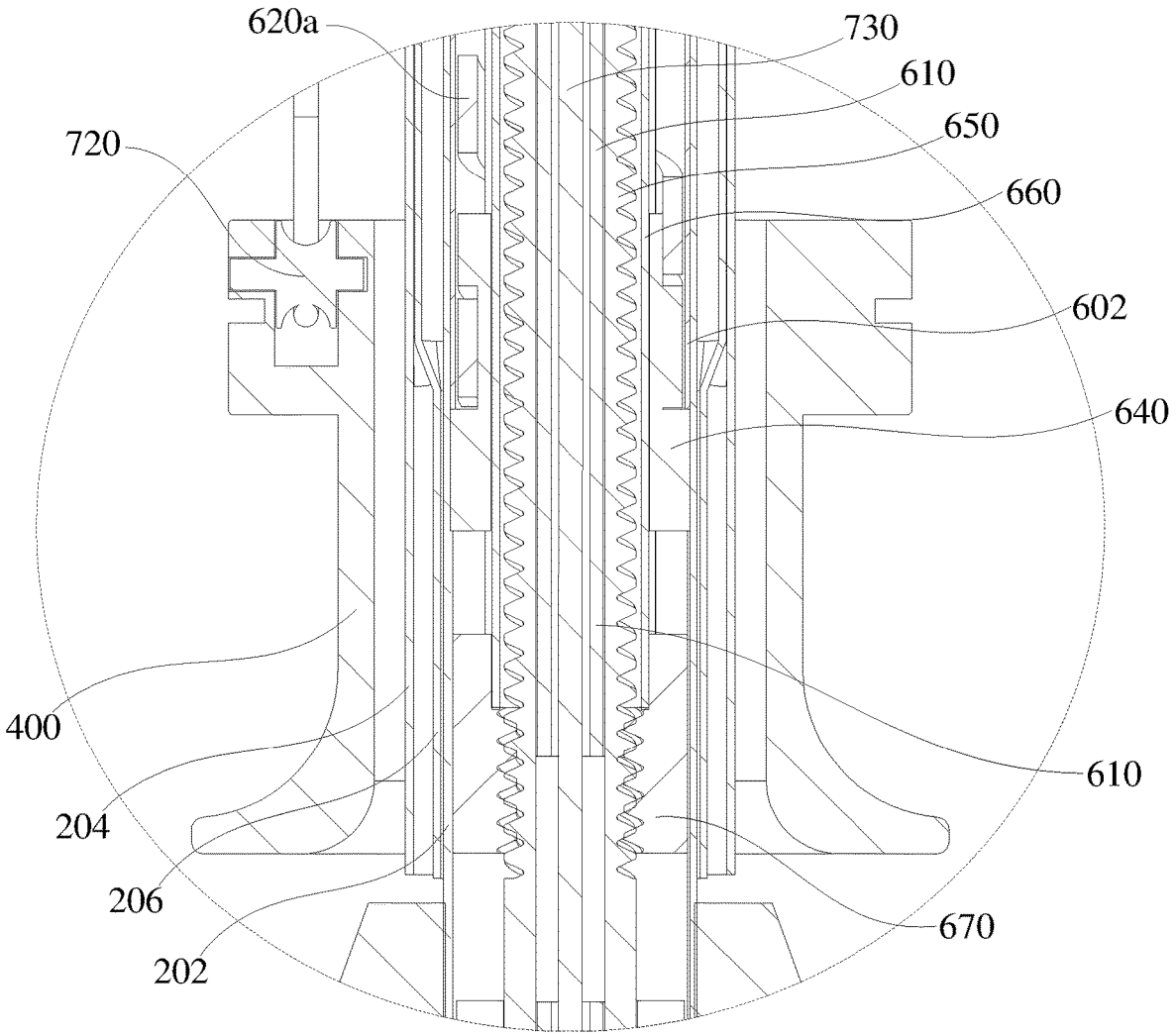
FIG. 12 is a partial enlarged view at D in FIG. 10.

In an embodiment, as shown in FIG. 1 to FIG. 3, the umbrella head 100 includes a shell 110 and a driving assembly 120 arranged in the shell 110. The shell 110 is provided with an umbrella opening button 112 and an umbrella retracting button 114, both the umbrella opening button 112 and the umbrella retracting button 114 are electrically connected to the driving assembly 120. When the umbrella opening button 112 is pressed, an output shaft of the driving assembly 120 rotates clockwise or counterclockwise. When the umbrella retracting button 114 is pressed, the output shaft of the driving assembly 120 rotates counterclockwise or clockwise. When the umbrella opening button 112 or the retracting button 114 is pressed, the rotation direction of the output shaft of the driving assembly 120 is opposite.

In an embodiment, the umbrella head 100 also includes a battery and an integrated circuit board arranged in the shell 110. The battery is used to supply a power for the driving assembly 120, the integrated circuit board and other components. The circuit board is used to control a working mode of the driving assembly 120. The umbrella head 100 also includes a charging interface arranged at a bottom of the shell 110, through which the battery can be charged.

As shown in FIG. 1 to FIG. 8, the middle rod 200 includes a plurality of casings sleeved from inside to outside, and the casings can be pulled apart to form an end-to-end long rod. An innermost casing of the middle rod 200 is the inner casing 202, and an outermost casing of the middle rod 200 is the outer casing 204.

In an embodiment, one end of the inner casing 202 is connected to the shell 110 of the umbrella head 100. In this way, after the middle rod 200 is pulled apart to form a long rod, the shell 110, the inner casing 202 and the outer casing 204 are arranged in sequence.

The upper nest 300 is arranged at an end of the outer casing 204 away from the umbrella head 100.

The lower nest 400 is slidably disposed on the outer casing 204.

The umbrella rib 500 includes a first rib 510, a second rib 520, a tension spring 530 and a third rib 540. One end of the first rib 510 is connected to the upper nest 300. One end of the second rib 520 is connected to the lower nest 400, and another end of the second rib 520 is slidably connected to the first rib 510. Two ends of the tension spring 530 are respectively connected to the first rib 510 and the second rib 520. The third rib 540 is connected to another end of the first rib 510.

The umbrella cloth is arranged on the umbrella rib 500.

In an embodiment, the umbrella pole device 12 also includes an umbrella pole transmission assembly 600 and an umbrella rib transmission assembly 700. The umbrella pole transmission assembly 600 is cooperated with the umbrella pole transmission assembly 700, so that when the umbrella opening button 112 is pressed, the driving assembly 120 can open the electric umbrella 10 through the umbrella pole transmission assembly 600 and the umbrella rib transmission assembly 700. When the umbrella retracting button 114 is pressed, the driving assembly 120 can retract the electric umbrella 10 through the umbrella pole transmission assembly 600 and the umbrella rib transmission assembly 700.

In an embodiment, the umbrella pole transmission assembly 600 is arranged in the middle rod 200 of the electric umbrella 10. When the umbrella pole transmission assembly 600 exerts a force on the middle rod 200, the multiple casings of the middle rod 200 can be pulled apart to form the end-to-end long rod, so that the umbrella pole of the electric umbrella 10 is extended. After the force exerted by the umbrella pole transmission assembly 600 on the middle rod 200 is canceled, under a force of the tension spring 530, the multiple casings of the middle rod 200 can get sleeved from inside to outside, thereby completing a step of shortening the umbrella pole of the electric umbrella 10.

In an embodiment, the umbrella pole transmission assembly 600 exerts a force on the upper nest 300, the upper nest 300 is arranged at the end of the outer casing 204 away from the umbrella head 100, so that the umbrella pole transmission assembly 600 indirectly exerts the force on the outer casing 204 through the upper nest 300.

In an embodiment, as shown in FIG. 3 to FIG. 17, the umbrella pole transmission assembly 600 is arranged in the inner casing 202. The umbrella pole transmission assembly 600 includes a first transmission tube 610 and a second transmission tube 620, the first transmission tube 610 is telescopically sleeved with the second transmission tube 620, one of the first transmission tube 610 and the second transmission tube 620 is a rectangular spring, and one end of the first transmission tube 610 is rotatably connected to the umbrella head 100.

When the first transmission tube 610 rotates in a first direction, the second transmission tube 620 can move (screw out) toward a direction away from the umbrella head 100, and can apply a force to the outer casing 204, so that the multiple casings of the middle rod 200 can be pulled apart to form the end-to-end long rod. In this way, the umbrella pole of the electric umbrella 10 is extended.

When the first transmission tube 610 rotates in a second direction, the second transmission tube 620 can move (screw in) towards a direction close to the umbrella head 100 to return to an original position, thereby canceling the force exerted on the outer casing 204. In this way, under an action of other elements, the multiple casings of the middle rod 200 can get sleeved from inside to outside, so as to complete a step of shortening the umbrella pole of the electric umbrella 10.

The first direction is opposite to the second direction, for example, when the first direction is clockwise, the second direction is counterclockwise. When the first direction is counterclockwise, the second direction is clockwise.

In the umbrella pole transmission assembly 600, one end of the first transmission tube 610 is rotatably connected to the umbrella head 100, and the first transmission tube 610 is telescopically sleeved with the second transmission tube 620. When the first transmission tube 610 rotates, the second transmission tube 620 can move towards the end away from the umbrella head 100, and can apply the force to the outer casing 204, so that the multiple casings of the middle rod 200 are pulled apart to form the end to end long rod. In this way, a compression of the first transmission tube 610 and the second transmission tube 620 can be avoided, that is, a compression of the rectangular spring can be avoided. Therefore, when the first transmission tube 610 is connected to the driving assembly 120, and is driven to rotate by the driving assembly 120, a torque requirement for the driving assembly 120 is relatively low. The driving assembly 120 with a small torque can be used to drive the first transmission tube 610 to rotate, and the driving assembly 120 with a small torque is generally smaller in size, thereby reducing a size of the umbrella head 100 and miniaturizing the electric umbrella 10. Moreover, in an actual production and manufacturing, a price of the rectangular spring is far lower than that of the threaded rod when the same effect is achieved, and a use of the rectangular spring as the transmission tube can reduce a production cost of the electric umbrella 10.

It should be noted that the rectangular spring is also called as a mold spring, because a material is a square wire (an ordinary spring is made of a round wire material), and a cross section of the square wire is rectangular, so it is called the rectangular spring.

In an embodiment, as shown in FIG. 3 to FIG. 12, the second transmission tube 620 is a rectangular spring **620*a*, and the rectangular spring 620*a* is sleeved outside the first transmission tube 610**.

In an embodiment, as shown in FIG. 3 to FIG. 8, the umbrella pole transmission assembly 600 further includes a guiding spring portion 630 and a first slider 640. The guiding spring portion 630 is arranged at an end of the first transmission tube 610 away from the umbrella head 100. The guiding spring portion 630 is provided with a first guiding spring passage 632. At least part of the coils **622*a* of the rectangular spring 620*a* are arranged in the first guiding spring passage 632. The first slider 640 is slidably sleeved outside the first transmission tube 610, and is arranged between the umbrella head 100 and the rectangular spring 620*a*, the first slider 640 is connected to an end of the rectangular spring 620*a* near the umbrella head 100, and the first slider 640 can confine a relative rotation between the rectangular spring 620*a* and the guiding spring portion 630**.

When the first transmission tube 610 rotates, the guiding spring portion 630 is driven to rotate, and the first slider 640 can confine a relative rotation between the rectangular spring 620*a* and the guiding spring portion 630, so that the rectangular spring 620*a* can move on the first transmission tube 610 and perform a linear motion while being aligned with the guiding spring portion 630 to rotate synchronously. Moreover, the first slider 640 is slidably sleeved outside the first transmission tube 610, and is connected to the end of the rectangular spring 620*a* close to the umbrella head 100, so that the first slider 640 can also move on the first transmission tube 610 and perform the linear motion while the rectangular spring 620*a* is performing the linear motion.

When the first transmission tube 610 rotates in the first direction, the rectangular spring 620*a* and the first slider 640 move on the first transmission tube 610 toward the direction away from the umbrella head 100, so that the rectangular spring 620*a* extends (screws in) from an end of the guiding spring portion 630 away from the first transmission tube 610, and exerts the force on the middle rod 200, so that multiple casings of the middle rod 200 are pulled apart to form the end to end long rod. In this way, the umbrella pole of the electric umbrella 10 will be extended.

When the first transmission tube 610 rotates in the second direction, the rectangular spring 620*a* and the first slider 640 move on the first transmission tube 610 towards the direction close to the umbrella head 100. The rectangular spring 620*a* extends (screw in) to the end of the guiding spring portion 630 away from the first transmission tube 610 can return to the original position, thereby canceling the force exerted by the rectangular spring 620*a* on the middle rod 200. In this way, under the action of other elements, the multiple casings of the middle rod 200 can be sleeved from inside to outside, so as to complete the step of shortening the umbrella pole of the electric umbrella 10.

In an embodiment, through setting the first slider 640 not to rotate, the relative rotation between the rectangular spring 620*a* and the guiding spring portion 630 is confined through the first slider 640.

In an embodiment, an outer wall of the first slider 640 is cooperated with the inner wall of the inner casing 202 to confine the rotation of the first slider 640, but the inner wall of the first slider 640 is not cooperated with the outer wall of the first transmission tube 610, thus cannot confine the rotation of the first slider 640. That is, the first slider 640 cannot rotate in the inner casing 202, but the first transmission tube 610 can rotate in the first slider 640.

In an embodiment, both the outer wall of the first slider 640 and the inner wall of the inner casing 202 are in a multi-faceted structure, and face numbers of the outer wall of the first slider 640 is the same as those of the inner wall of the inner casing 202, which are correspondingly set. In an embodiment, the outer wall of the first slider 640 has a regular hexagonal structure, and the inner wall of the inner casing 202 also has the regular hexagonal structure.

In an embodiment, the outer wall of the first transmission tube 610 may be a cylindrical structure, or a multi-faceted structure. The inner wall of the first slider 640 is separated from the outer wall of the first transmission tube 610 by a first distance, and the inner wall of the rectangular spring 620*a* is separated from the outer wall of the first transmission tube 610 by a second distance. Both the first distance and the second distance are satisfied, and neither the inner wall of the first slider nor the inner wall of the rectangular spring 620*a* interferes with the rotation of the first transmission tube 610.

In an embodiment shown in FIG. 3 to FIG. 8, the middle rod 200 includes two casings. At this time, the middle rod 200 belongs to a two-fold electric umbrella.

In an embodiment, as shown in FIG. 9 to FIG. 12, the umbrella pole transmission assembly 600 includes a threaded tube 650, an external transmission tube 660 and a nut 670.

One end of the threaded tube 650 is rotatably connected to the umbrella head 100.

The first transmission tube 610 is slidably inserted into an end of the threaded tube 650 away from the umbrella head 100. The outer wall of the first transmission tube 610 is cooperated with the inner wall of the threaded tube 650 to confine the relative rotation between the first transmission tube 610 and the threaded tube 650. That is, when the threaded tube 650 rotates, the first transmission tube 610 is linked with the threaded tube 650 and rotates synchronously with the threaded tube 650, so that the first transmission tube 610 does not rotate relative to the threaded tube 650.

The external transmission tube 660 is slidably sleeved on the threaded tube 650, when the external transmission tube 660 slides on the threaded tube 650, the first transmission tube 610 and the guiding spring portion 630 are driven to slide.

The nut 670 is sleeved on the outside of the threaded tube 650 and is screwed to the threaded tube 650. The outer wall of the nut 670 is cooperated with the inner wall of the inner casing 202 so that the nut 670 can move on the threaded tube 650. The nut 670 is arranged between the umbrella head 100 and the external transmission tube 660, and is fixedly connected to the end of the external transmission tube 660 close to the umbrella head 100.

Both the rectangular spring 620*a* and the first slider 640 are slidably sleeved outside the external transmission tube 660, and the inner wall of the first slider 640 is cooperated with the outer wall of the external transmission tube 660 to confine the rotation of the first slider 640.

When the threaded tube 650 rotates, the first transmission tube 610 is driven to rotate, then the guiding spring portion 630 is driven to rotate, while the first slider 640 is confined by the outer wall of the external transmission tube 660 and cannot rotate, so that the rectangular spring 620*a* can slide on the external transmission tube 660 while rotating synchronously with the guiding spring portion 630 to perform the linear motion. Moreover, the first slider 640 is slidably sleeved on the external transmission tube 660, and is connected to the end of the rectangular spring 620*a* close to the umbrella head 100, so that the first slider 640 can also move on the external transmission tube 660 while the rectangular spring 620*a* is performing the linear motion. In addition, when the threaded tube 650 rotates, the outer wall of the nut 670 is cooperated with the inner wall of the inner casing 202 so that the nut 670 can move on the threaded tube 650, so that the nut 670 can drive the external transmission tube 660 to slide on the threaded tube 650 to perform the linear motion, and the external transmission tube 660 can drive the first transmission tube 610 and the guiding spring portion 630 to slide and perform the linear motion.

Since the external transmission tube 660, the first transmission tube 610 and the guiding spring portion 630 can perform the linear motion, a displacement of the linear motion of the rectangular spring 620*a* is larger, which is suitable for the middle rod 200 with three or more folds.

In an embodiment, when the middle rod 200 belongs to an electric umbrella with three or more folds and the middle rod 200 includes three or more casings, a middle tube 206 is arranged between the inner casing 202 and the outer casing 204. An amount of the middle tube 206 is greater than or equal to one. In an embodiment shown in FIG. 8 to FIG. 11, the number of the middle tube 206 is equal to 1, and the middle rod 200 belongs to the three-fold electric umbrella.

In an embodiment, the umbrella pole transmission assembly 600 further includes a T-shaped cylindrical pin 680 and a bushing 690. The T-shaped cylindrical pin 680 is sleeved outside of the first transmission tube 610, and an inner wall of the T-shaped cylindrical pin 680 is cooperated with the outer wall of the first transmission tube 610 to confine the rotation of the T-shaped cylindrical pin 680.

The guiding spring portion 630 is sleeved outside the T-shaped cylindrical pin 680, and a head end 682 of the T-shaped cylindrical pin 680 is arranged between the guiding spring portion 630 and the umbrella head 100.

The bushing 690 is sleeved outside the first transmission tube 610, and an end of the bushing 690 away from the umbrella head 100 is rotatably connected to the head end 682 of the T-shaped cylindrical pin 680. The end of the external transmission tube 660 away from the umbrella head 100 is sleeved on the outside of the casing 690. Thus, when the external transmission tube 660 slides on the threaded tube 650, the first transmission tube 610 and the guiding spring portion 630 can be driven to slide.

In an embodiment, both the outer wall of the first transmission tube 610 and the inner wall of the threaded tube 650 have the multi-faceted structure, and face numbers of the outer wall of the first transmission tube 610 is the same as those of the inner wall of the threaded tube 650, which are correspondingly set. Specifically, in an embodiment, the outer wall of the first transmission tube 610 has a regular five-sided structure, and the inner wall of the threaded tube 650 also has the regular five-sided structure.

In an embodiment, both the outer wall of the nut 670 and the inner wall of the inner casing 202 have the multi-faceted structure, and face numbers of the outer wall of the nut 670 is the same as those of the inner wall of the inner casing 202, which are correspondingly set. Specifically, in an embodiment, the outer wall of the nut 670 has the regular hexagonal structure, and the inner wall of the inner casing 202 also has the regular hexagonal structure.

In an embodiment, both the inner wall of the first slider 640 and the outer wall of the external transmission tube 660 have the multi-faceted structure, and face numbers of the inner wall of the first slider 640 is the same as those of the outer wall of the external transmission tube 660, which are correspondingly set. Specifically, in an embodiment, the inner wall of the first slider 640 has the regular five-sided structure, and the outer wall of the external transmission tube 660 also has the regular five-sided structure.

In an embodiment, both the inner wall of the T-shaped cylindrical pin 680 and the outer wall of the first transmission tube 610 have the multi-faceted structure, and face numbers of the inner wall of the T-shaped cylindrical pin 680 is the same as those of the outer wall of the first transmission tube 610, which are correspondingly set. Specifically, in an embodiment, the inner wall of the T-shaped cylindrical pin 680 has the regular five-sided structure, and the outer wall of the first transmission tube 610 also has the regular five-sided structure.

When the threaded tube 650 rotates, the first transmission tube 610 is driven to rotate, the T-shaped cylindrical pin 680 is driven to rotate synchronously by the first transmission tube 610, so that the guiding spring portion 630 is driven to rotate by the T-shaped cylindrical pin 680, but the first slider 640 is confined by the outer wall of the external transmission tube 660 and cannot rotate, so that the rectangular spring 620*a* can slide on the external transmission tube 660 while rotating synchronously with the guiding spring portion 630 to perform the linear motion. Moreover, the first slider 640 is slidably sleeved on the external transmission tube 660, and is connected to the end of the rectangular spring 620*a* close to the umbrella head 100, so that the first slider 640 can also move on the external transmission tube 660 while the rectangular spring 620*a* is performing the linear motion. In addition, when the threaded tube 650 rotates, the outer wall of the nut 670 is cooperated with the inner wall of the inner casing 202 so that the nut 670 can move on the threaded tube 650, so that the external transmission tube 660 can be driven by the nut 670 to slide on the threaded tube 650 to perform the linear motion, then the first transmission tube 610 and the guiding spring portion 630 can be driven by the external transmission tube 660 to slide through the bushing 690 and perform the linear motion.

Referring to embodiments shown in FIG. 3 to FIG. 12, the umbrella pole transmission assembly 600 further includes a first reinforcing tube 602 sleeved outside the rectangular spring 620*a*, the first reinforcing tube 602 is relatively fixed to the rectangular spring 620*a*. An integrity of the first reinforcing tube 602 and the rectangular spring 620*a* can effectively increase a supporting force of the rectangular spring 620*a*, so that when the umbrella pole of the electric umbrella 10 is extended, the rectangular spring 620*a* can be effectively prevented from swinging.

In an embodiment, one end of the first reinforcing tube 602 close to the umbrella head 100 is connected to the first slider 640. In this way, both the first reinforcing tube 602 and the rectangular spring 620*a* are connected to the first slider 640, so that the first reinforcing tube 602 and the rectangular spring 620*a* are relatively fixed.

In an embodiment, an end of the first reinforcing tube 602 close to the umbrella head 100 is connected to the first slider 640, and an end of the first reinforcing tube 602 away from the umbrella head 100 is connected to the outer casing 204. In this way, a connection of the first reinforcing tube 602 can be made more stable. It can be understood that, in other embodiments, the end of the first reinforcing tube 602 close to the umbrella head 100 may also be connected to the first slider 640, or the end of the first reinforcing tube 602 away from the umbrella head 100 may be connected to the outer casing 204.

Figure 13:
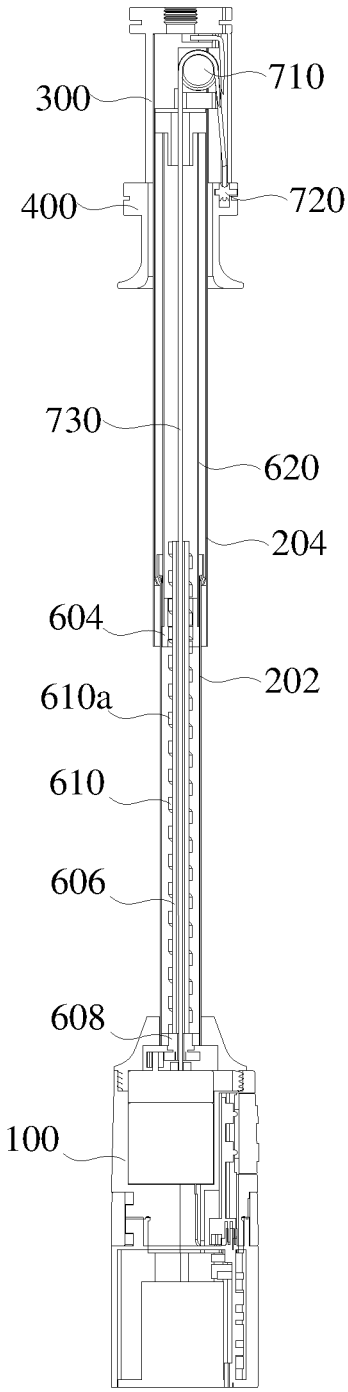
FIG. 13 is a sectional view of an umbrella pole device of an electric umbrella according to an embodiment of the present disclosure.
Figure 14:
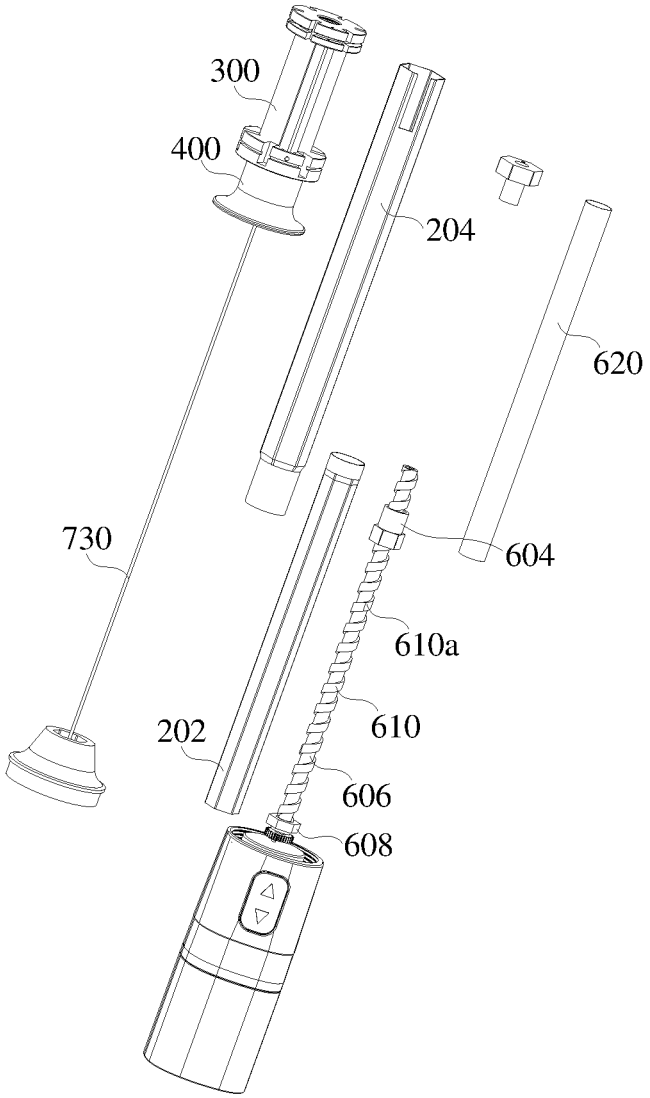
FIG. 14 is a three-dimensional exploded view of the umbrella pole device of the electric umbrella in FIG. 13.
Figure 15:
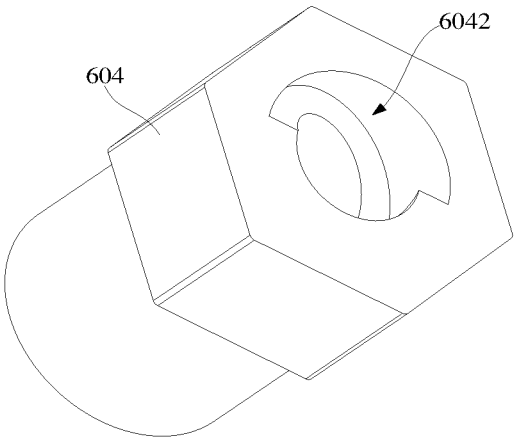
FIG. 15 is a three-dimensional structural schematic view of a second slider in FIG. 14.

In an embodiment, as shown in FIG. 13 to FIG. 15, the first transmission tube 610 is the rectangular spring 610*a*, and the second transmission tube 620 is sleeved outside the rectangular spring 610*a*.

The umbrella pole transmission assembly 600 also includes a second slider 604. The second slider 604 is sleeved outside the rectangular spring 610*a*. The second slider 604 is arranged between the umbrella head 100 and the second transmission tube 620, and is fixedly connected to the end of the second transmission tube 620 close to the umbrella head 100.

The inner wall of the second slider 604 is provided with a second guiding spring passage 6042, and at least part of the coils of the rectangular spring 610*a* are arranged in the second guiding spring passage 6042. The outer wall of the second slider 604 is cooperated with the inner wall of the inner casing 202 so that the second slider 604 can move on the rectangular spring 610*a*. A principle that the second slider 604 moves on the rectangular spring 610*a* is similar to a threaded connection between a stud and a nut.

In the umbrella pole transmission assembly 600, when the rectangular spring 610*a* rotates, because the outer wall of the second slider 604 is cooperated with the inner wall of the inner casing 202, the relative rotation of the first slider 640 and the rectangular spring 610*a* can be confined, so that the second slider 604 can move on the rectangular spring 610*a* and perform the linear motion. The second transmission tube 620 is fixed on the second slider 604, so that when the second slider 604 performs the linear motion, the second transmission tube 620 can also move on the rectangular spring 610*a* to perform the linear motion.

In an embodiment, both the inner wall of the second slider 604 and the outer wall of the inner casing 202 have the multi-faceted structure, and face numbers of the inner wall of the second slider 604 is the same as those of the outer wall of the inner casing 202, which are correspondingly set. Specifically, in an embodiment, the inner wall of the second slider 604 has the regular hexagonal structure, and the outer wall of the inner casing 202 also has the regular hexagonal structure.

In an embodiment, the umbrella pole transmission assembly 600 further includes a second reinforcing tube 606. The rectangular spring 610*a* is sleeved outside the second reinforcing tube 606 and is relatively fixed to the second reinforcing tube 606. One end of the second reinforcing tube 606 close to the umbrella head 100 is rotatably connected to the umbrella head 100. An integrity of the rectangular spring 610*a* and the second reinforcing tube 606 can effectively increase a supporting force of the rectangular spring 610*a*, so that when the umbrella pole of the electric umbrella 10 is extended, the rectangular spring 610*a* can be effectively prevented from swinging. Moreover, the rectangular spring 610*a* can also be rotatably connected to the umbrella head 100 through the second reinforcing tube 606, which facilitates the rotatable connection of the rectangular spring 610*a* and the umbrella head 100.

In an embodiment, the umbrella pole transmission assembly 600 further includes a mounting portion 608 rotatably connected to the umbrella head 100, and the second reinforcing tube 606 and the rectangular spring 610*a* are both fixed on the installation part 608.

In an embodiment, the rectangular spring 610*a* is interference fit with the second reinforcing tube 606. In this way, it is more convenient for the second slider 604 to move on the rectangular spring 610*a*. Specifically, in an embodiment, an outer diameter of the second reinforcing tube 606 is equal to or slightly larger than an inner diameter of the rectangular spring 610*a*.

Figure 16:
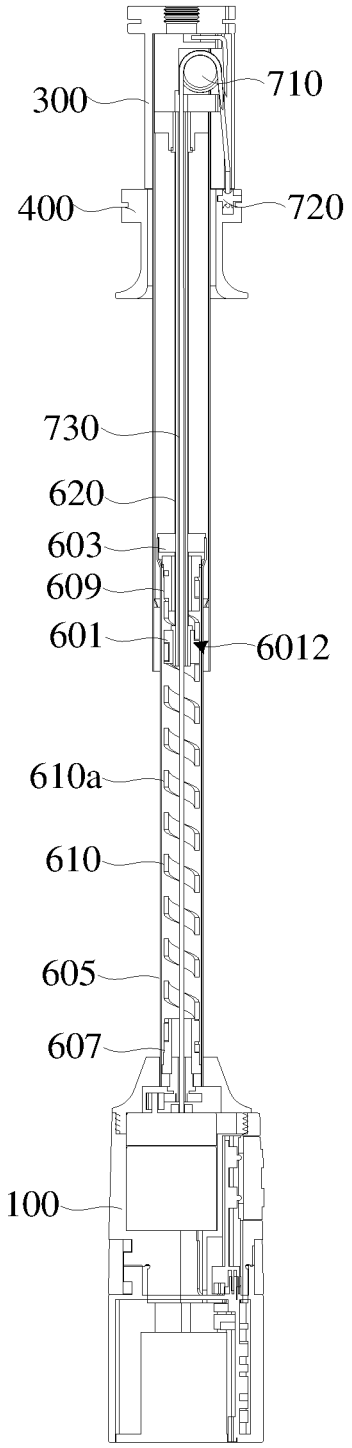
FIG. 16 is a sectional view of an umbrella pole device of an electric umbrella according to an embodiment of the present disclosure.
Figure 17:
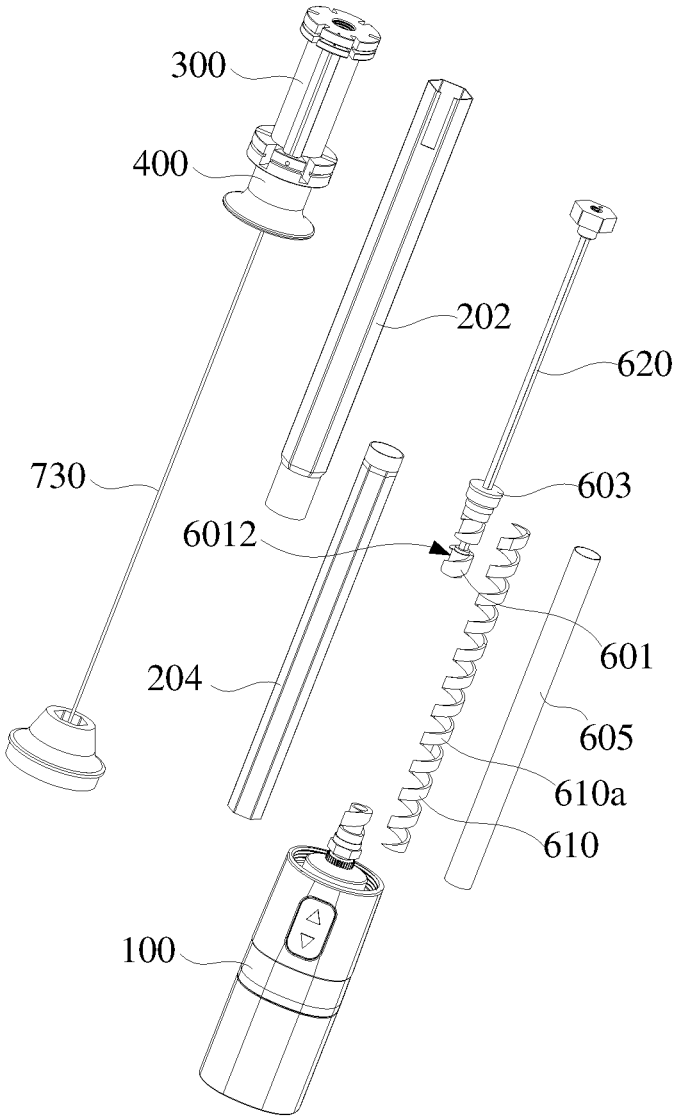
FIG. 17 is a three-dimensional exploded view of the umbrella pole device of the electric umbrella in FIG. 16.

In an embodiment, as shown in FIG. 16 and FIG. 17, the first transmission tube 610 is the rectangular spring 610*a* sleeved outside the second transmission tube 620.

The umbrella pole transmission assembly 600 also includes a third slider 601 and an anti-rotation block 603.

The rectangular spring 610*a* is sleeved outside the third slider 601. The third slider 601 is fixedly connected to an end of the second transmission tube 620 close to the umbrella head 100. An outer wall of the third slider 601 is provided with a third guiding spring passage 6012, and at least part of the coils of the rectangular spring 610*a* are arranged in the third guiding spring passage 6012.

The anti-rotation block 603 is arranged on the end of the inner casing 202 away from the umbrella head 100, and the second transmission tube 620 is slidably inserted on the anti-rotation block 603. An inner wall of the anti-rotation block 603 is cooperated with the outer wall of the second transmission tube 620 so that the third slider 601 can move on the rectangular spring 610*a*.

In the umbrella pole transmission assembly 600, when the rectangular spring 610*a* rotates, because the inner wall of the anti-rotation block 603 is cooperated with the outer wall of the second transmission tube 620, the relative rotation between the second transmission tube 620 and the rectangular spring 610*a* can be confined, so that a relative rotation between the third slider 601 and the rectangular spring 610*a* can be confined, and the third slider 601 can move on the rectangular spring 610*a* to perform the linear motion. The second transmission tube 620 is fixed on the third slider 601, and the second transmission tube 620 is slidably inserted on the anti-rotation block 603, so that when the third slider 601 performs the linear motion, the second transmission tube 620 can also move on the rectangular spring 610*a* and perform the linear motion.

In an embodiment, both the inner wall of the anti-rotation block 603 and the outer wall of the second transmission tube 620 have the multi-faceted structure, and face numbers of the inner wall of the anti-rotation block 603 is the same as those of the outer wall of the second transmission tube 620, which are correspondingly set. Specifically, in an embodiment, the inner wall of the anti-rotation block 603 has the regular five-sided structure, and the outer wall of the second transmission tube 620 also has the regular five-sided structure.

In an embodiment, the umbrella pole transmission assembly 600 further includes a third reinforcing tube 605 sleeved outside the rectangular spring 610*a* and the third reinforcing tube 605 is relatively fixed to the rectangular spring 610*a*. An integrity of the rectangular spring 610*a* and the third reinforcing tube 605 can effectively increase the supporting force of the rectangular spring 610*a*, so that when the umbrella pole of the electric umbrella 10 is extended, the rectangular spring 610*a* can be effectively prevented from swinging. Moreover, the rectangular spring 610*a* can also be rotatably connected to the umbrella head 100 through the third reinforcing tube 605, which facilitates the rotatable connection of the rectangular spring 610*a* and the umbrella head 100.

In an embodiment, the umbrella pole transmission assembly 600 further includes a first connecting block 607 and a second connecting block 609. Two ends of the rectangular spring 610*a* are respectively sleeved on the first connecting block 607 and the second connecting block 609, and the third slider 601 is arranged between the first connecting block 607 and the second connecting block 609. Two ends of the third reinforcing tube 605 are respectively sleeved on the first connecting block 607 and the second connecting block 609. The first connecting block 607 is rotatably connected to the umbrella head 100.

In an embodiment, as shown in FIG. 1 to FIG. 17, the electric umbrella 10 further includes an umbrella rib transmission assembly 700 cooperated with the umbrella pole transmission assembly 600. When the umbrella pole transmission assembly 600 completes the step of opening the umbrella pole of the electric umbrella 10, the umbrella rib transmission assembly 700 stretches the umbrella rib 500 of the electric umbrella 10. After the force exerted on the middle rod 200 by the umbrella pole transmission assembly 600 is canceled, under an action of the tension spring 530, the umbrella rib transmission assembly 700 retracts the umbrella rib 500 of the electric umbrella 10, the multiple casings of the middle rod 200 get sleeved from inside to outside, and the step of shortening the umbrella pole of the electric umbrella 10 is completed.

In an embodiment, the umbrella rib transmission assembly 700 includes at least one upper pulley 710, at least one lower pulley 720, and a stay rope 730. The upper pulley 710 is provided on the upper nest 300, and the lower pulley 720 is arranged on the lower nest 400. One end of the stay rope 730 is fixed on the umbrella head 100, and another end of the stay rope 730 passes through the transmission tube 620, alternately goes around the upper pulley 710 and the lower pulley 720, and is fixed on the upper nest 300 or the lower nest 400.

When using the electric umbrella 10, after pressing the umbrella opening button 112, the driving assembly 120 rotates, the first transmission tube 610 is driven to rotate, and the second transmission tube 620 is unscrewed. After a force is applied to the upper nest 300, the upper nest 300 fixed on the outer casing 204 moves away from the umbrella head 100, so that the multiple casings of the middle rod 200 are pulled apart to the form the end-to-end long rod, and the step of opening the umbrella pole of the electric umbrella 10 is completed. Because the upper nest 300 fixed on the outer casing 204 moves away from the umbrella head 100, the stay rope 730 will pull the lower nest 400 to slide on the outer casing 204 towards the upper nest 300, the second umbrella rib 520 is driven to slide on the first umbrella rib 510, thereby opening the umbrella rib 500, and the step of opening the umbrella rib 500 of the electric umbrella 10 is completed. At this time, the electric umbrella 10 is in an open state, and the tension spring 530 is in a compressed state.

Then press the umbrella retracting button 114, the driving assembly 120 rotates reversely to drive the first transmission tube 610 to rotate, the second transmission tube 620 is screwed in, and the force exerted on the upper nest 300 by the second transmission tube 620 is canceled. The lower nest 400 moves toward the umbrella handle 100 by the tension of the tension spring 530, inwardly retracts the second umbrella rib 520 and the first umbrella rib 510, and the step of retracting the umbrella rib 500 of the electric umbrella 10 is completed. The lower pulley 720 drives the stay rope 730 to pull the upper nest 300, so that the upper nest 300 drives the outer casing 204 to move toward the umbrella handle 100, the inner casing 202, the middle tube 206 and the outer casing 204 get sequentially sleeved from inside to outside, and the step of folding the umbrella pole of the electric umbrella 10 is completed.

Under the action of the tension spring 530, the second umbrella rib 520 slides reversely on the first umbrella rib 510, the stay rope 730 will pull the lower nest 400 and the upper nest 300 to slide towards the umbrella head 100 on the outer casing 204, and the step of retracting the umbrella rib 500 of the umbrella 10 is completed. The multiple casings of the middle rod 200 get sleeved from inside to outside, and the step of folding the umbrella pole of the electric umbrella 10 is completed.

In an embodiment, an amount of the upper pulley 710 and the lower pulley 720 is 1. One end of the stay rope 730 is fixed to the umbrella head 100, and another end of the rope 730 passes through an innermost tube of the umbrella pole transmission assembly 600 (in an embodiment shown in FIG. 3 to FIG. 12, the innermost tube is the first transmission tube 610, in an embodiment shown in FIG. 13 to FIG. 15, the innermost tube is the second reinforcing tube 606, in an embodiment shown in FIG. 16 and FIG. 17, the innermost tube is the second transmission tube 620). The stay rope 730 bypasses the upper pulley 710 and the lower pulley 720 in sequence, then the other end of the stay rope 730 is fixed on the upper nest 300. In this way, the stay rope 730 is divided into three sections. Correspondingly, in an embodiment, an amount of the middle tube 206 is 1, that is, the middle rod 200 includes three casings. Correspondingly, the electric umbrella 10 is a three-fold electric umbrella.

In other embodiments, when it is necessary to design a four-fold or even a five-fold electric umbrella, by setting a corresponding number of the upper pulley 710, the lower pulley 720, the stay rope 730 is divided into four sections, or even five sections, and the middle rod 200 includes four or even five casings.

In an embodiment, as shown in FIG. 3, the driving assembly 120 includes a motor 122, a main gear 124, a slave gear 126 and a gearbox. The main gear 124 is arranged on an output shaft of the motor 122, the slave gear 126 is sleeved on an end of the first transmission tube 610 close to the umbrella head 100, and a speed change gear of the gearbox is respectively engaged with the main gear 124 and the slave gear 126.

According to the FIG. 1 to FIG. 17, the present disclosure also provides a telescopic device including a mounting seat, a casing assembly and an inner transmission assembly. The mounting seat is the umbrella head 100, the casing assembly is the middle rod, and the inner transmission assembly is the umbrella pole transmission assembly 600.

It should be noted that the installation seat is the umbrella head 100, which means that the installation seat not only includes part of or all of the elements in the embodiment shown in FIG. 3 to FIG. 17, but may also include other elements.

The casing assembly is the middle rod 200, which means that the casing assembly not only includes part of or all of the elements in the embodiment shown in FIG. 3 to FIG. 17, but may also include other elements.

The inner transmission assembly is the umbrella pole transmission assembly 600, which means that the inner transmission assembly not only includes part of or all of the elements in the embodiment shown in FIG. 3 to FIG. 17, but may also include other elements.

Figure 18:
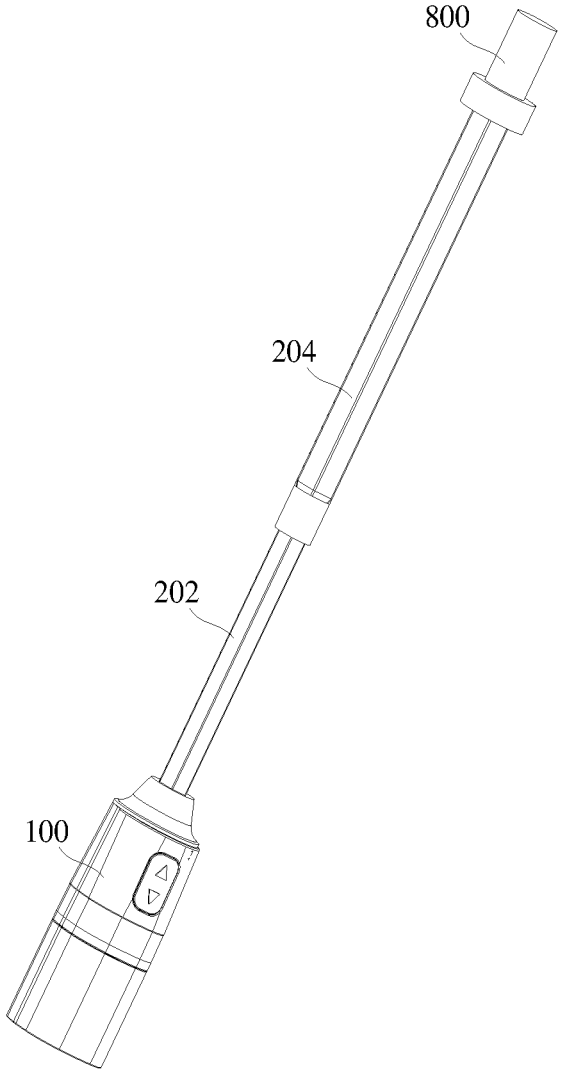
FIG. 18 is a three-dimensional structural schematic view of the telescopic device according to an embodiment of the present disclosure.

In an embodiment, the telescopic device can be applied to a selfie stick, a clothes rail or a robot. That is, the selfie stick, the clothes rail or a robot, which includes the telescopic device. At this time, as shown in FIG. 18, the end of the outer casing 204 away from the installation seat is provided with a clamp positioning member 800.

When the telescopic device is applied to the selfie stick, the clamp positioning member 800 is used to fix a mobile phone or a camera. When the telescopic device is applied to the clothes rail, the clamp positioning member 800 is a fork. When the telescopic device is applied to the robot, the clamp positioning member 800 is a manipulator.

The above descriptions are only embodiments of the present disclosure, and are not intended to limit the scope of the present disclosure. Under the inventive concept of the present disclosure, any equivalent structural transformations made by using the contents of the description and drawings of the present disclosure, or direct/indirect disclosures in other related technical fields are included in the scope of the present disclosure.

What is claimed is:

1. An umbrella pole device, comprising:

an umbrella head;

a middle rod, comprising a plurality of casings, wherein the plurality of the casings are pulled apart to form an end-to-end long rod, the casing in an innermost part of the middle rod is an inner casing, the casing in an outermost part of the middle rod is an outer casing, one end of the inner casing is connected to the umbrella head; and an umbrella pole transmission assembly arranged in the inner casing, wherein the umbrella pole transmission assembly comprises a first transmission tube and a second transmission tube, the first transmission tube is telescopically sleeved with the second transmission tube, one end of the first transmission tube is rotatably connected to the umbrella head, and one of the first transmission tube and the second transmission tube is a rectangular spring, wherein when the first transmission tube rotates in a first direction, the second transmission tube moves toward a direction away from the umbrella head to exert a force on the outer casing, and the plurality of casings of the middle rod are pulled apart to form the end-to-end long rod;

when the first transmission tube rotates in a second direction, the second transmission tube moves towards a direction close to the umbrella head to cancel the force applied on the outer casing, wherein the second direction is opposite to the first direction.

2. The umbrella pole device of claim 1, wherein the second transmission tube is a rectangular spring, and the rectangular spring is sleeved outside the first transmission tube;

the umbrella pole transmission assembly further comprises a guiding spring portion and a first slider, the guiding spring portion is arranged at an end of the first transmission tube away from the umbrella head, the guiding spring portion is provided with a first guiding spring passage, at least part of coils of the rectangular spring are arranged in the first guiding spring passage, the first slider is slidably sleeved outside the first transmission tube, the first slider is arranged between the umbrella head and the rectangular spring, the first slider is connected to one end of the rectangular spring close to the umbrella head, and an outer wall of the first slider is cooperated with an inner wall of the inner casing to confine a rotation of the first slider.

3. The umbrella pole device of claim 2, wherein the umbrella pole transmission assembly further comprises a threaded tube, an external transmission tube and a nut;

one end of the threaded tube is rotatably connected to the umbrella head;

the first transmission tube is slidably inserted into an end of the threaded tube away from the umbrella head, and an outer wall of the first transmission tube is cooperated with an inner wall of the threaded tube to confine a relative rotation between the first transmission tube and the threaded tube;

the external transmission tube is slidably sleeved outside the threaded tube, and when sliding on the threaded tube, the external transmission tube is configured to drive the first transmission tube and the guiding spring portion to slide;

the nut is sleeved outside the threaded tube and is screwed with the threaded tube, an outer wall of the nut is cooperated with the inner wall of the inner casing so that the nut is configured to move on the threaded tube, the nut is arranged between the umbrella head and the external transmission tube, and the nut is fixedly connected to an end of the external transmission tube close to the umbrella head; and the rectangular spring and the first slider are slidably sleeved outside the external transmission tube, and the inner wall of the first slider is cooperated with the outer wall of the external transmission tube to confine the rotation of the first slider.

4. The umbrella pole device of claim 3, wherein the umbrella pole transmission assembly further comprises a T-shaped cylindrical pin and a bushing, the T-shaped cylindrical pin is sleeved outside the first transmission tube, and an inner wall of the T-shaped cylindrical pin is cooperated with the outer wall of the first transmission tube to limit a rotation of the T-shaped cylindrical pin;

the guiding spring portion is sleeved outside the T-shaped cylindrical pin, and a head end of the T-shaped cylindrical pin is arranged between the guiding spring portion and the umbrella head;

the bushing is sleeved outside the first transmission tube, and an end of the bushing away from the umbrella head is rotatably connected to the head end of the T-shaped cylindrical pin; and an end of the external transmission tube away from the umbrella head is sleeved outside the bushing.

5. The umbrella pole device of claim 2, wherein the umbrella pole transmission assembly further comprises a first reinforcing tube, the first reinforcing tube is sleeved outside the rectangular spring, and is relatively fixed to the rectangular spring, and one end of the first reinforcing tube close to the umbrella head is connected to the first slider.

6. The umbrella pole device of claim 1, wherein the first transmission tube is a rectangular spring, and the second transmission tube is sleeved outside the rectangular spring;

the umbrella pole transmission assembly further comprises a second slider, the second slider is sleeved outside the rectangular spring, the second slider is arranged between the umbrella head and the second transmission tube, and is fixedly connected to an end of the second transmission tube close to the umbrella head;

an inner wall of the second slider is provided with a second guiding spring passage, at least part of the coils of the rectangular spring are arranged in the second guiding spring passage, and an outer wall of the second slider is cooperated with the inner wall of the inner casing so that the second slider is configured to move on the rectangular spring.

7. The umbrella pole device of claim 6, wherein the umbrella pole transmission assembly further comprises a second reinforcement tube, the rectangular spring is sleeved outside the second reinforcement tube and is relatively fixed to the second reinforcement tube, and an end of the second reinforcing tube close to the umbrella head is rotatably connected to the umbrella head.

8. The umbrella pole device of claim 1, wherein the first transmission tube is a rectangular spring, and the rectangular spring is sleeved outside the second transmission tube;

the umbrella pole transmission assembly further comprises a third slider and an anti-rotation block;

the rectangular spring is sleeved outside the third slider, the third slider is fixedly connected to the end of the second transmission tube close to the umbrella head, an outer wall of the third slider is provided with a third guiding spring passage, at least part of the coils of the rectangular spring are arranged in the third guiding spring passage;

the anti-rotation block is arranged on an end of the inner casing away from the umbrella head, the second transmission tube is slidably inserted on the anti-rotation block, and an inner wall of the anti-rotation block is cooperated with the outer wall of the second transmission tube so that the third slider is configured to move on the rectangular spring.

9. The umbrella pole device of claim 8, wherein the umbrella pole transmission assembly further comprises a third reinforcing tube, and the third reinforcing tube is sleeved outside the rectangular spring and is relatively fixed to the rectangular spring.

10. The umbrella pole device of claim 1, wherein the umbrella pole device further comprises a driving assembly arranged in the umbrella head, the driving assembly comprises a motor, a main gear, a slave gear and a gearbox, the main gear is arranged on an output shaft of the motor, the slave gear is arranged at one end of the first transmission tube close to the umbrella head, and a speed change gear of the gearbox is respectively engaged with the main gear and the slave gear.

11. The umbrella pole device of claim 1, wherein the umbrella pole device further comprises an upper nest, a lower nest and an umbrella rib transmission assembly;

the upper nest is arranged at the end of the outer casing away from the umbrella head and is configured to be pushed by the second transmission tube;

the lower nest is slidably arranged on the outer casing, and the lower nest is arranged between the umbrella head and the upper nest;

the umbrella rib transmission assembly comprises at least one upper pulley, at least one lower pulley, and a stay rope, the upper pulley is arranged on the upper nest, the lower pulley is arranged on the lower nest, one end of the stay rope is fixed to the umbrella head, another end passes through an innermost tube of the umbrella pole transmission assembly to alternately bypasses the upper pulley and the lower pulley, and is fixed on the upper nest or the lower nest.

12. An electric umbrella, comprising:

the umbrella pole device of claim 1; and an umbrella rib device comprising an umbrella rib and an umbrella cloth arranged on the umbrella rib;

wherein the umbrella rib comprises a first rib, a second rib, a tension spring and a third rib, one end of the first rib is connected to the upper nest, one end of the second rib is connected to the lower nest, another end of the second rib is slidably connected to the first rib, two ends of the tension spring are respectively connected to the first rib and the second rib, and the third rib is connected to another end of the first rib.

13. A telescopic device, comprising:

a mounting seat;

a casing assembly, comprising a plurality of casings, wherein the plurality of the casings are pulled apart to form an end-to-end long rod, the casing in an innermost part of the casing assembly is an inner casing, the casing in an outermost part of the casing assembly is an outer casing, one end of the inner casing is connected to the mounting seat; and an inner transmission assembly arranged in the inner casing, wherein the inner transmission assembly comprises a first transmission tube and a second transmission tube, the first transmission tube is telescopically sleeved with the second transmission tube, one end of the first transmission tube is rotatably connected to the mounting seat, and one of the first transmission tube and the second transmission tube is a rectangular spring.

* * * * *